US010483655B2

(12) United States Patent
Vouvakis et al.

(10) Patent No.: US 10,483,655 B2
(45) Date of Patent: Nov. 19, 2019

(54) LOW CROSS-POLARIZATION DECADE-BANDWIDTH ULTRA-WIDEBAND ANTENNA ELEMENT AND ARRAY

(71) Applicants: UNIVERSITY OF MASSACHUSETTS, Boston, MA (US); THE GOVERNMENT OF THE UNITED STATES OF AMERICA AS REPRESENTED BY THE SECRETARY OF THE NAVY, Arlington, VA (US)

(72) Inventors: Marinos N. Vouvakis, Amherst, MA (US); Rick W. Kindt, Arlington, VA (US); John T. Logan, Warwick, RI (US)

(73) Assignee: UNIVERSITY OF MASSACHUSETTS, Boston, MA (US)

( * ) Notice: Subject to any disclaimer, the term of this patent is extended or adjusted under 35 U.S.C. 154(b) by 0 days.

(21) Appl. No.: 15/554,657

(22) PCT Filed: Mar. 3, 2016

(86) PCT No.: PCT/US2016/020669

§ 371 (c)(1),
(2) Date: Aug. 30, 2017

(87) PCT Pub. No.: WO2016/141177

PCT Pub. Date: Sep. 9, 2016

(65) Prior Publication Data

US 2018/0069322 A1 Mar. 8, 2018

Related U.S. Application Data

(60) Provisional application No. 62/127,565, filed on Mar. 3, 2015.

(51) Int. Cl.
*H01Q 13/08* (2006.01)
*H01Q 21/06* (2006.01)
(Continued)

(52) U.S. Cl.
CPC ..... *H01Q 21/064* (2013.01); *H01Q 13/085* (2013.01); *H01Q 21/0025* (2013.01); *H01Q 21/24* (2013.01)

(58) Field of Classification Search
CPC ..... H01Q 13/085; H01Q 21/064; H01Q 21/0025; H01Q 21/24
See application file for complete search history.

(56) References Cited

U.S. PATENT DOCUMENTS 5,175,560 A 12/1992 Lucas et al.
5,642,121 A 6/1997 Martek et al.
(Continued)

FOREIGN PATENT DOCUMENTS

CN 203826551 U 9/2014

OTHER PUBLICATIONS

International Search Report and Written Opinion for application No. PCT/US2016/020669 dated May 17, 2016.
(Continued)

*Primary Examiner* — Hoang V Nguyen
*Assistant Examiner* — Awat M Salih
(74) *Attorney, Agent, or Firm* — Renner, Otto, Boisselle & Sklar, LLP

(57) ABSTRACT

Various aspect and embodiments of a modular wideband antenna element are disclosed. The antenna element includes a support structure comprising a feed network and first and second arbitrarily-shaped radiator elements extending along a main axis of the antenna elements. Each of the first and second arbitrarily-shaped radiator elements comprises disconnected radiator body components separated by
(Continued)

gap regions. Each arbitrarily-shaped radiator elements has a wider end and a tapering free end to provide a tapered slot region. The wider ends of the first and second arbitrarily-shaped radiator elements are located closer to the support structure. The tapering free ends of first and second arbitrarily-shaped radiator elements are located farther from the support structure. The first and second arbitrarily-shaped radiator elements are configured to be electrically coupled to the feed network.

26 Claims, 34 Drawing Sheets

(51) Int. Cl.
*H01Q 21/24* (2006.01)
*H01Q 21/00* (2006.01)

(56) References Cited

U.S. PATENT DOCUMENTS 6,246,377 B1 6/2001 Aiello et al.
6,317,094 B1 11/2001 Wu et al.
7,652,631 B2 * 1/2010 McGrath ..... H01Q 1/38 343/767
8,253,641 B1 8/2012 Waterman
2001/0048395 A1 12/2001 Apostolos
2004/0080465 A1 4/2004 Hendler et al.
2005/0007286 A1 1/2005 Troll et al.
2005/0219126 A1 10/2005 Rebeiz et al.
2006/0061513 A1 3/2006 Sato
2008/0246680 A1 10/2008 Rawnick et al.
2010/0176997 A1 7/2010 Ikegaya et al.
2012/0001826 A1 1/2012 Achour et al.
2012/0229361 A1 9/2012 Goins et al.
2012/0299785 A1 11/2012 Bevelacqua
2013/0241787 A1 * 9/2013 Coburn ..... H01Q 13/106 343/770
2014/0138546 A1 5/2014 Iluz et al.
2014/0218251 A1 8/2014 Waschenko et al.

OTHER PUBLICATIONS

Extended European Search Report in application No. 16759488.6 dated Sep. 27, 2018.

* cited by examiner

LOW CROSS-POLARIZATION DECADE-BANDWIDTH ULTRA-WIDEBAND ANTENNA ELEMENT AND ARRAY

CROSS-REFERENCE TO RELATED APPLICATIONS

This application claims priority to and the benefit under 35 U.S.C. § 119(e) of U.S. Provisional Application No. 62/127,565 titled "LOW CROSS-POLARIZATION DECADE-BANDWIDTH ULTRA-WIDEBAND ANTENNA ELEMENT AND ARRAY" and filed on Mar. 3, 2015, which is herein incorporated by reference in its entirety for all purposes.

FEDERALLY SPONSORED RESEARCH

This invention was made with government support under Grant No. NRL N00173-15-1-G005 awarded by NAVAL RESEARCH LAB. The U.S. government has certain rights in this invention.

BACKGROUND

Electronically scanned arrays (ESAs) with ultra-wideband (UWB) and wide-scan radiation performance are desirable for applications such as multi-functional systems, high-throughput or low-power communications, high-resolution and clutter resilient radar/sensing, and electromagnetic warfare systems. To this day, the most extensively utilized UWB-ESA element is the Vivaldi, or tapered-slot or flared-notch antenna, due to its excellent impedance performance. Vivaldi arrays are capable of achieving instantaneous bandwidths (defined as the ratio of the highest frequency to the lowest frequency) in excess of three octaves (>8:1). Several prominent embodiments of Vivaldi arrays have been realized over the past decade, including microstrip/stripline variants that using high-volume printed circuit board (PCB) manufacturing, and all-metal versions for high-power handling synthesized through electrical discharge machining (EDM) or additive manufacturing (3D printing) technologies.

Despite their excellent impedance performance at such wide bandwidths, all Vivaldi arrays are known to suffer from significant degradation of polarization isolation when scanning in the non-principal planes, especially at the diagonal planes. This is particularly problematic as the radiation energy instead of being carried in the intended radiation polarization (co-polarization) it is distributed in a polarization that is orthogonal to the intended one (cross-polarization) as the array scans away from the broadside and the principal radiation planes (E-/H-planes). This unintended polarization distortion causes polarization mismatch between the polarization vectors of the receiving antenna/array ($\hat{p}_a$) and the transmitting antenna/array ($\hat{p}_{tr}$) leading to loss of service or reduction of throughputs in communication scenarios because the polarization loss factor (PLF)

$$PLF=|\hat{p}_a \cdot \hat{p}_{tr}|^2$$

in the Friis propagation equation approaches zero. Similarly for a radar scenario where the antenna/array is monostatic (transmitter/receiver are co-located), the polarization mismatch (or polarization isolation) of incident and scattered returns would succumb to high losses and may reduce the detection range. Similarly, in polarometric radar poor polarization isolation could reduce accuracy, target identification or clutter reduction capabilities. Therefore, in the absence of polarization correctional measures, significant losses incur as a consequence of high PLF that effectively inhibit operation when scanning off-axis in the diagonal planes. Polarization correctional procedures based on the re-adjustment of the array's excitation are known to achieve acceptable cross-polarization rejection in the diagonal planes, but they are only available to dual-polarized configurations could require additional feeding circuitry responsible for producing frequency-dependent amplitude/phase weights to each orthogonal feed. In addition to an added complexity and implementation cost, these look-up-table (LUT) based polarization corrections methods are scan angle and frequency-dependent and are inherently narrow beam and narrowband thus inhibiting the UWB instantaneous bandwidth potential of the Vivaldi array in the off-axis diagonal planes. As a result, Vivaldi antenna arrays have intrinsic restrictions when scanning in the diagonal planes that limit their performance. Another significant disadvantage of the LUT-based polarization correction approach is the unintended increase in polarization side-lobes.

It is believed that root cause of this off-axis diagonal plane scanning polarization purity degradation in Vivaldi array stems from the high profile of the array that is otherwise necessary for good impedance matching at the lower frequency band. An intrinsic bandwidth and polarization isolation design trade-off is thus engendered in scanned Vivaldi arrays, limiting effective scan volume or instantaneous bandwidth in Vivaldi. It is noted that this bandwidth and polarization isolation trade-off becomes more pronounced as the Vivaldi array design become more wideband, i.e. a Vivaldi array with 4:1 bandwidth has approximately 10 dB polarization isolation when scanned 45 degrees in the D-plane, but a 7:1 array has only 0 dB polarization isolation, respectively.

As a means to improve non-principal plane scanning polarization isolation of UWB-ESAs, low-profile vertically-integrated radiators such as the bunny ear antenna, bunny ear combline antenna (BECA), and balanced antipodal Vivaldi antenna (BAVA) have been proposed. The radiating conductors of each antenna incorporate flared dipole-like fins on the order of $\lambda_{high}/2$ that resemble miniaturized versions of a tapered slot from a Vivaldi antenna. These antennas are capable of achieving good polarization isolation but at the expense of bandwidth or/and matching level. The maximum documented instantaneous bandwidth achieved by these types of arrays is from a modified BAVA, termed U-channel BAVA array attaining a decade bandwidth (10:1), but at VSWR<3 for broadside with VSWR rising above 4 in H-plane 45 degree scanning. For well-matched bandwidths (broadside VSWR<2), comparable to those produced by Vivaldi arrays, typical values for said arrays range from 3:1 to 6:1, with some requiring external baluns that complicate high-volume fabrication.

Thus, a need remains for an antenna element that exhibits very large instantaneous bandwidths (>6:1) while maintaining excellent impedance matching (VSWR<2) and good polarization isolation in all non-principal scanning planes, including the diagonal one (better or equal than 15 dB at an elevation angle of 45 degrees).

SUMMARY OF INVENTION

Aspects and embodiments are directed to various embodiments of an antenna element disclosed herein that are capable of simultaneously achieving bandwidths in excess of one decade and high scanning polarization isolation i.e. high co-polarization and low-cross polarization in the entire $\theta<60°$ scan volume (including the diagonal planes) due to various inventive structures. One aspect of the various disclosed embodiments of antenna elements are their unique ability to retain a high-profile for wideband and wide-scan matching considerations and for also controlling the amount of vertical current contributing to radiation that would otherwise lead to poor diagonal plane off-axis polarization isolation when compared to prior art Vivaldi-type antenna element structures. Still another aspect of various disclosed embodiments of an antenna element according to the invention are that each includes arbitrarily-shaped disconnected radiator body components extending along the main axis of the antenna element which are separated by electrically small gap regions. Still other aspects and embodiments can be provided and operate as a single element antenna offering the same radiation performance advantages, including a wider and less frequency dependent field-of-few.

A modular wideband antenna element includes a support structure comprising a feed network and first and second arbitrarily-shaped radiator elements extending along a main axis of the antenna elements. Each of the first and second arbitrarily-shaped radiator elements comprises disconnected radiator body components separated by electrically small gap regions. Each arbitrarily-shaped radiator elements has a wider end and a tapering free end to provide a tapered slot region. The wider ends of the first and second arbitrarily-shaped radiator elements are located closer to the support structure. The tapering free ends of first and second arbitrarily-shaped radiator elements are located farther from the support structure. The first and second arbitrarily-shaped radiator elements are configured to be electrically, conductively or capacitively coupled to the feed network structure.

Aspects and embodiments of the modular wideband antenna element further comprise capacitive enhancing elements located between the disconnected radiator body components. Aspects and embodiments of this modular wideband antenna element further comprise the disconnected radiator body components not being electrically connected to the support structure, wherein the capacitive enhancing elements provide for current to flow at frequencies of interest, thereby emulating a Vivaldi current distribution at frequencies of interest. Aspects and embodiments of this modular wideband antenna element further comprise the capacitive enhancing elements including edge plating of the disconnected radiator body components. Aspects and embodiments of this modular wideband antenna element further comprise the capacitive enhancing elements include vias connecting the disconnected radiator body components. Aspects and embodiments of this modular wideband antenna element further comprise the capacitive enhancing elements having inward notches into the disconnected radiator body components. Aspects and embodiments of this modular wideband antenna element further comprise the capacitive enhancing elements include arbitrarily shaped plates that extend laterally and connect to the disconnected radiator body components.

Aspects and embodiments of the modular wideband antenna element further comprise the gap regions being configured to tune-out slot resonance.

Aspects and embodiments of the modular wideband antenna element further comprise the gap regions filled with non-conductive or low-conductivity materials with low relative permittivity $1\leq\varepsilon_r\leq10$.

Aspects and embodiments of the modular wideband antenna element further comprise the gap regions being filled with non-conductive or low-conductivity materials selected from the list of air, PTFE dielectric, bonding ply, and/or foam.

Aspects and embodiments of the modular wideband antenna element further comprise any of a number, location, size, and material composition of the gap regions can be varied along the longitudinal axis of the radiator element.

Aspects and embodiments of the modular wideband antenna element further comprise the support structure protrudes into a first gap region Aspects and embodiments of the modular wideband antenna element further comprise the antenna element being entirely or partially embedded within a non-conductive or low-conductivity medium so that the disconnected radiator body components and gap regions are both within the medium.

Aspects and embodiments of the modular wideband antenna element further comprise the gap regions being supported by non-conductive or low-conductivity layers that fully extend across adjacent antenna elements.

Aspects and embodiments of the modular wideband antenna element further comprise the disconnected radiator body components incorporating disconnected metallic components separated from one another along a gap parallel to the main axis of the antenna body.

Aspects and embodiments of the modular wideband antenna element further comprise the first and second arbitrarily-shaped radiator elements comprising a microstrip topology.

Aspects and embodiments of the modular wideband antenna element further comprise the support structure comprising a slot-line cavity and a ground plane.

Aspects and embodiments of the modular wideband antenna element further comprise the support structure comprising a microstrip balun terminated into a quarter-wave radial stub printed upon an opposite side of a mechanically supporting medium.

Aspects and embodiments of the modular wideband antenna element further comprise capacitive enhancing elements located between the disconnected radiator body components.

Aspects and embodiments of the modular wideband antenna element further comprise the first and second arbitrarily-shaped radiator elements comprising a stripline topology. Aspects and embodiments of this modular wideband antenna element further comprise the support structure comprising a slot-line cavity and a ground plane. Aspects and embodiments of this modular wideband antenna element further comprise the support structure comprising a microstrip balun terminated into a quarter-wave radial stub printed upon an opposite side of a mechanically supporting medium. Aspects and embodiments of this modular wideband antenna element further comprise capacitive enhancing elements located between the disconnected radiator body components.

Aspects and embodiments of the modular wideband antenna element further comprise the first and second arbitrarily-shaped radiator elements comprising a Vivaldi embodiment of the antenna element, wherein the disconnected radiator body components comprise all metallic disconnected components of radiator body spaced by gap regions filled with a low-conductivity material to provide spacing support for the metallic disconnected components of radiator body. Aspects and embodiments of this modular wideband antenna element further comprise the metallic disconnected components of radiator body being configured for high-power usage Aspects and embodiments of the modular wideband antenna element further comprise the first and second arbitrarily-shaped radiator elements made of hybrid fabrication methods. Aspects and embodiments of this modular wideband antenna element further comprise the first and second arbitrarily-shaped radiator elements comprising a hybrid design of PCB all-metal EDM or additive manufacturing (3D printing) methods. Aspects and embodiments of this antenna element include the hybrid design can be manufactured independently and joined afterwards without the need to maintain conductive connection between hybrid elements and the feed and structural support structure.

Aspects and embodiments of the modular wideband antenna element further comprise the first and second arbitrarily-shaped radiator elements comprising Body of Revolution (BOR) elements having a shape of a tapered cone manufactured with a lathe or similar technologies. Aspects and embodiments of this modular wideband antenna element further comprise that the first and second body of revolution elements can be manufactured independently and joined afterwards without the need to maintain conductive connection between the elements and the feed and structural support structure.

Aspects and embodiments of the modular wideband antenna element further comprise the first and second arbitrarily-shaped radiator elements comprising stepped notches having a taper that is stepped upwards in flat segments.

Aspects and embodiments of the modular wideband antenna element further comprise the stepped notches having steps of overall lesser thickness.

Aspects and embodiments of modular wideband antenna element further comprise a plurality of antenna elements configured as an antenna array. The antenna array includes a plurality of unit cells arranged in the antenna array, each of said unit cells including an antenna element, each said antenna element including the first and second arbitrarily-shaped radiator elements, each of the first and second arbitrarily-shaped radiator elements comprising the disconnected radiator body components separated by gap regions.

Still other aspects, embodiments, and advantages of these exemplary aspects and embodiments are discussed in detail below. Embodiments disclosed herein may be combined with other embodiments in any manner consistent with at least one of the principles disclosed herein, and references to "an embodiment," "some embodiments," "an alternate embodiment," "various embodiments," "one embodiment" or the like are not necessarily mutually exclusive and are intended to indicate that a particular feature, structure, or characteristic described may be included in at least one embodiment. The appearances of such terms herein are not necessarily all referring to the same embodiment.

BRIEF DESCRIPTION OF THE DRAWINGS

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. In the figures, each identical or nearly identical component that is illustrated in various figures is represented by a like numeral. For purposes of clarity, not every component may be labeled in every figure. In the figures.

DETAILED DESCRIPTION

Figure 1A:
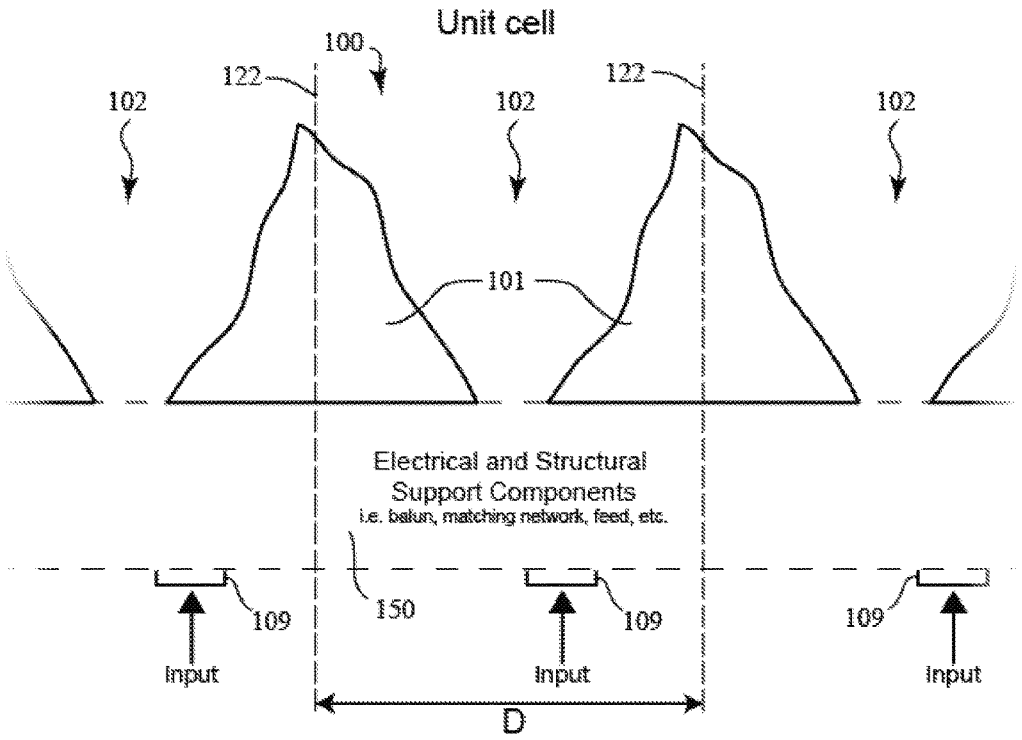
FIG. 1A PRIOR ART
FIG. 1A illustrates a prior-art Vivaldi antenna element.

Aspects and embodiments are directed to an antenna elements disclosed herein that are capable of simultaneously achieving bandwidths in excess of one decade while maintaining excellent impedance matching and polarization isolation in the diagonal scanning plane. Aspects and embodiments are directed to various antenna elements disclosed herein that are capable of simultaneously achieving bandwidths and high scanning polarization isolation i.e. high co-polarized fields and low cross-polarized fields in the entire $\theta<60°$ scan volume (including the diagonal planes) with various inventive antenna structures. Aspect and embodiments of various disclosed antenna elements are their unique ability to retain a high-profile for wideband and wide-scan matching considerations and also for controlling the amount of vertical-to-horizontal current ratio that is critical in maintaining good polarization isolation while scanning off-axis, as compared to prior art Vivaldi-type antenna element structures. Still another aspect and embodiment of various disclosed antenna elements are that they can include arbitrarily-shaped disconnected radiator body components extending along the main axis of the antenna element which are separated by electrically small gaps formed by appropriately chosen non-conducting i.e. dielectric or low-conductivity regions. Moreover the conductively disconnected region of the element radiator can be conductively disconnected to the orthogonal element polarization in dual polarization arrangements. This innovative aspect of the disclosure is also applicable to single polarization embodiments offering certain radiation performance advantages. However, it is also appreciated that the dual polarized embodiments can benefit most from such aspect since the dual polarized elements avoid the cumbersome and hard to build electrical contact over majority of the radiator region. It is further appreciated that even though most of the descriptions are presented for antenna arrays, the various aspects and embodiments of the antenna elements disclosed herein can be provided and operate as a single element antenna offering the same radiation performance advantages, including a wider and less frequency dependent field-of-few.

It is to be appreciated that embodiments of the methods and apparatuses discussed herein are not limited in application to the details of construction and the arrangement of components set forth in the following description or illustrated in the accompanying drawings.

The methods and apparatuses are capable of implementation in other embodiments and of being practiced or of being carried out in various ways. Examples of specific implementations are provided herein for illustrative purposes only and are not intended to be limiting. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

The popularity of Vivaldi antenna elements have led to a number of conceivable embodiments with unique feeding, electrical, and structural considerations. However, all Vivaldi antenna elements of the prior art consist of a feeding/support structure that is electrically connected to a tapered metallic flare that forms a tapered slot. A general topology of a Vivaldi element according to the prior art is depicted in FIG. 1A, where antenna elements of the Vivaldi-type 100 are composed of an arbitrarily-shaped conducting radiator body 101 forming tapered slot regions 102 and is conductively connected at its base to electrical and mechanical support structures 150 that contains feeds, baluns, and/or matching networks with a signal path to a guided wave feed port 109. The radiator body 101 may take on a plurality of shapes and sizes to form a plurality of tapered slot region 102 embodiments, altogether forming a Vivaldi-type antenna element 100 in which a plurality of these elements are directed towards service in a one-dimensional or two-dimensional periodic array with a period D (or $D_x$ and $D_y$ for the two-dimensional case).

Referring now to FIGS. 1B-F, there is illustrated various antenna elements according to this disclosure showing differences between various embodiments of the antenna element and the prior-art Vivaldi antenna element of FIG. 1A. According to aspects and embodiments of the various antenna elements 200 disclosed in FIGS. 1B-1F, the conductive antenna body 201 and the tapered slot 202 in a direction transverse to the main axis 222 of the antenna body (referred to as horizontally 'sliced' pieces) are provided as pieces or pieces are removed (sliced) and preferably replaced with either or both of a non-/low-conductivity material 210 such as a PTFE dielectric, bonding ply, or foam to provide gap regions 203. These non-/low-conductivity gap regions are electrically thin (typically $\lambda/10$-$\lambda/100$, where $\lambda$ is the wavelength at the highest frequency), and are typically vertically separated from one another by distances that range from a few to twenty times the gap thickness. In doing so, the various aspects and embodiments of antenna elements 200 include alternating exclusive metal and non-metal tapered sections along the main axis 222 of the antenna element body that extend from a flared opening into a section(s) of electrical/structural support components 150 incorporating a path to a feed port 109. Furthermore, the disconnected metallic body components 201 may also be separated from one another parallel to the main axis 222 of the antenna body (referred to as vertically 'cut' pieces). It is appreciated that a plurality of all said antenna components such as illustrated in FIGS. 1B-1F, including but not limited to the illustrated amount, shape, and location of slices' and 'cuts,' may be embodied.

As noted above, it is clear that Vivaldi antenna elements of the prior art have been popular choices for UWB-ESAs due to their wideband characteristics and design robustness, but have inherent scanning restrictions due to the very nature in which they obtain their wideband performance. The various aspect and embodiments of the inventive antenna element according to this disclosure intrinsically solve this quintessential diagonal plane scanning issue of prior art Vivaldi arrays that has come to be widely accepted as an inevitable design constraint. As a result, the various aspect and embodiments of the antenna element according to this disclosure uniquely provide efficient bandwidths in excess of one decade without the drawback of azimuth-dependent scanning restriction of the prior art Vivaldi antenna elements, to enable wide field-of-view UWB operation.

Figure 1B:
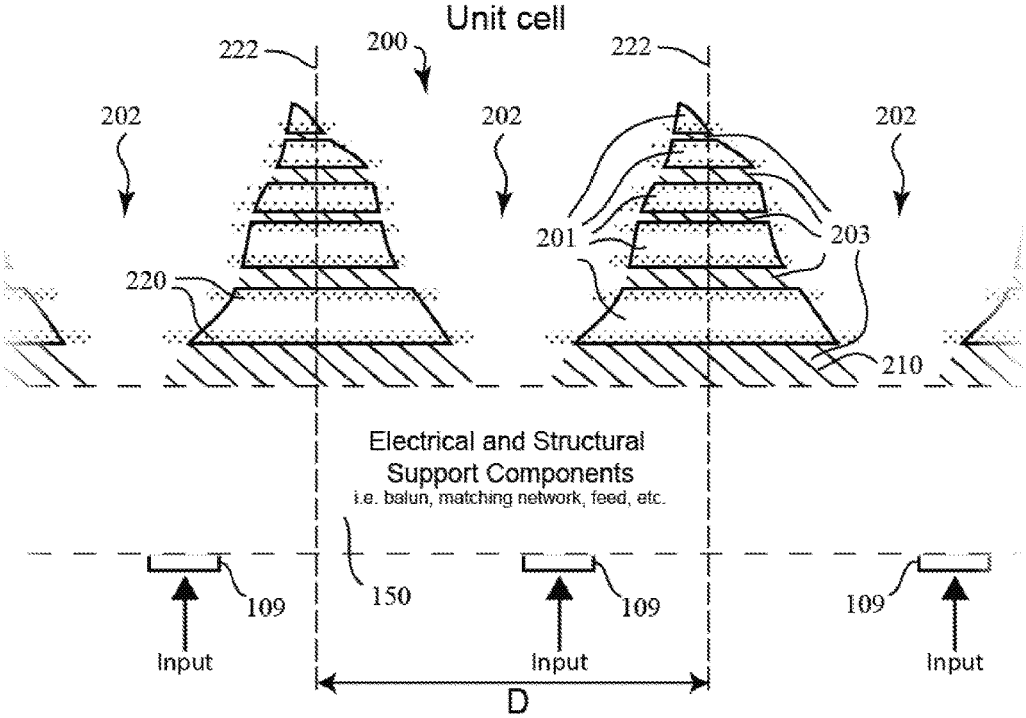
FIGS. 1B-F illustrate an antenna element according to invention, respectively, showing the differences between various embodiments of the antenna element and the prior-art Vivaldi antenna element.
Figure 1C:
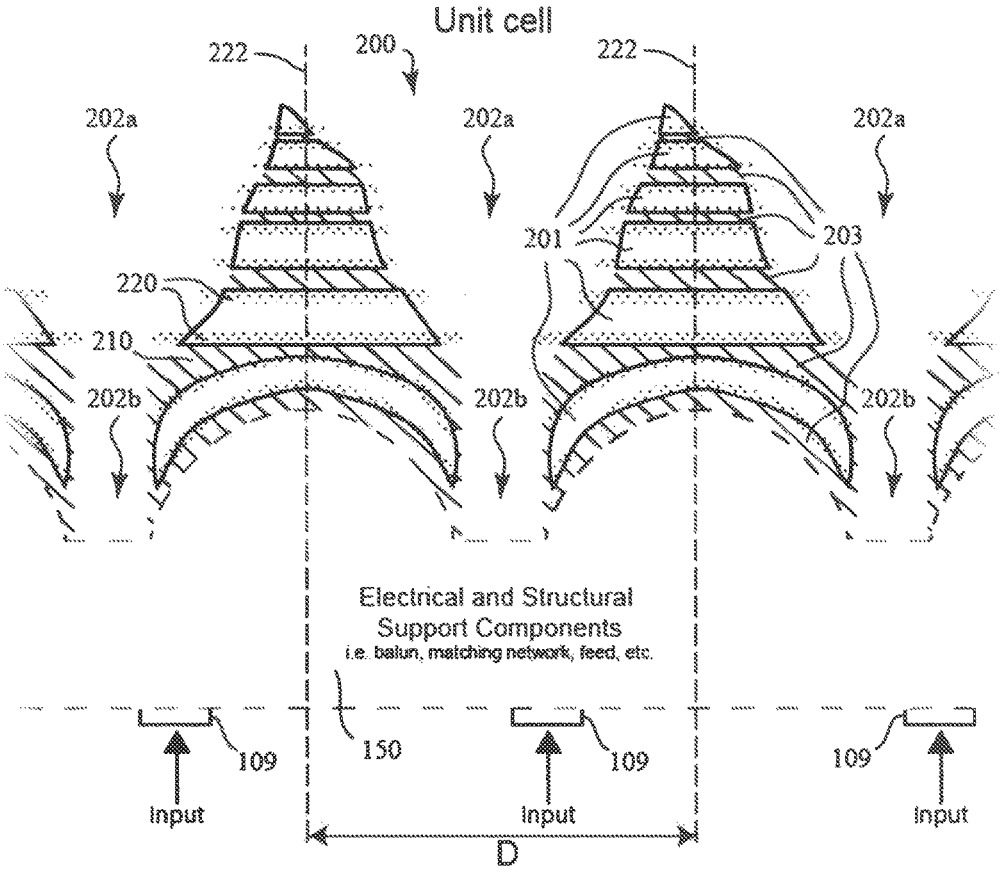

A general example of one inventive antenna element is illustrated in FIG. 1B. The inventive antenna element architecture incorporates a plurality of antenna elements 200 having an arbitrarily-shaped disconnected radiator body components 201 extending along the main axis of the antenna element 222 separated by gap regions 203. According to aspects of various embodiments, the gap regions 203 can be coupled to one another with capacitance enhancing structures 220 that, altogether with the electrically disconnected radiator body components 201 form a tapered slot region 202. The antenna elements 201 are supported by a plurality of electrical and structural support components 150 and coupled to feed port configurations 109. Unlike the prior art Vivaldi antenna elements, the radiator body 201 does not need to be connected to its electrical and structural support components 150, due to strong capacitive coupling that effectively allows conductive current to flow at the frequencies of interest, effectively emulating the Vivaldi current distribution at the frequencies of interest (lower frequency band but not higher frequencies which are not necessary for the correct operation). Also the carefully designed slices (location, shape, width, gap etc.) can be configured to tune-out slot resonance that would otherwise arise from slicing. The gap regions 203 are filled with non-conductive or low-conductivity mediums 210 preferably comprised of materials with low relative permittivity $1 \leq \varepsilon_r \leq 10$ such as air, PTFE dielectric, bonding ply, and/or foam. The number, location, size, and material composition of gap regions 203 may vary along the entirety of the radiator body 201 according to the invention. Additionally, the electrical and structural support components 150 may take on any shape and may even protrude into the disconnecting region of low-conductivity medium 210 as shown in FIG. 1C. Its shape is also shown to form its own tapered slot region 202*b* that is unique from the tapered slot region 202*a*. Furthermore, the antenna element according to various aspects and embodiments of the invention 200 may be entirely embedded within the non-conductive or low-conductivity medium 210 as depicted, for example, in FIG. 1D so that the antenna body 201 and gap regions 203 are both structurally supported by a medium(s) 210. An alternative embodiment of the antenna element is illustrated in FIG. 1E, where the gap regions 203 are supported by non-conductive or low-conductivity layers 211 that fully extend across adjacent antenna elements 200. An additional embodiment is illustrated in FIG. 1F that in addition to the horizontal gap regions further incorporates disconnected metallic components 201 separated from one another in a parallel fashion to the main axis 222 of the antenna body. From the above, it is clear that the antenna element 200 according to the invention is different (comprises a plurality of different structures) from the structure of Vivaldi-type antennas 100 (See FIG. 1A), as the antenna element according to the invention forms a radiator body including electrically (conductively) disconnected metallic pieces in some manner as opposed to the traditional electrically (conductively) connected (continuous) metal radiator body 101. It should also be noted that a plurality of configurations are possible such as illustrated by way of example in FIGS. 1B-1F, and that any combination of aspects from FIGS. 1 B-E may be embodied in an antenna element in addition to the flexibility of all inherent design parameters.

It is appreciated that the various embodiments of antenna element disclosed herein, having a radiator body including electrically (conductively) disconnected metallic pieces in various manners disclosed herein, are capable of simultaneously achieving bandwidths in excess of one decade and high scanning polarization isolation i.e. high co-polarization with concurrent low cross-polarization in the entire $\theta<60°$ scan volume (including the diagonal planes) due to various inventive structures. One aspect of the disclosed various embodiments of antenna elements are their unique ability to retain a high-profile necessary for wideband matching considerations while also controlling the amount of vertical-to-horizontal current ratio contributing to radiation that would normally lead to poor diagonal plane polarization purity while scanning off-axis. The various inventive structures as disclosed herein also use tapered slot design and feed principles to achieve wideband performance.

Figure 1D:
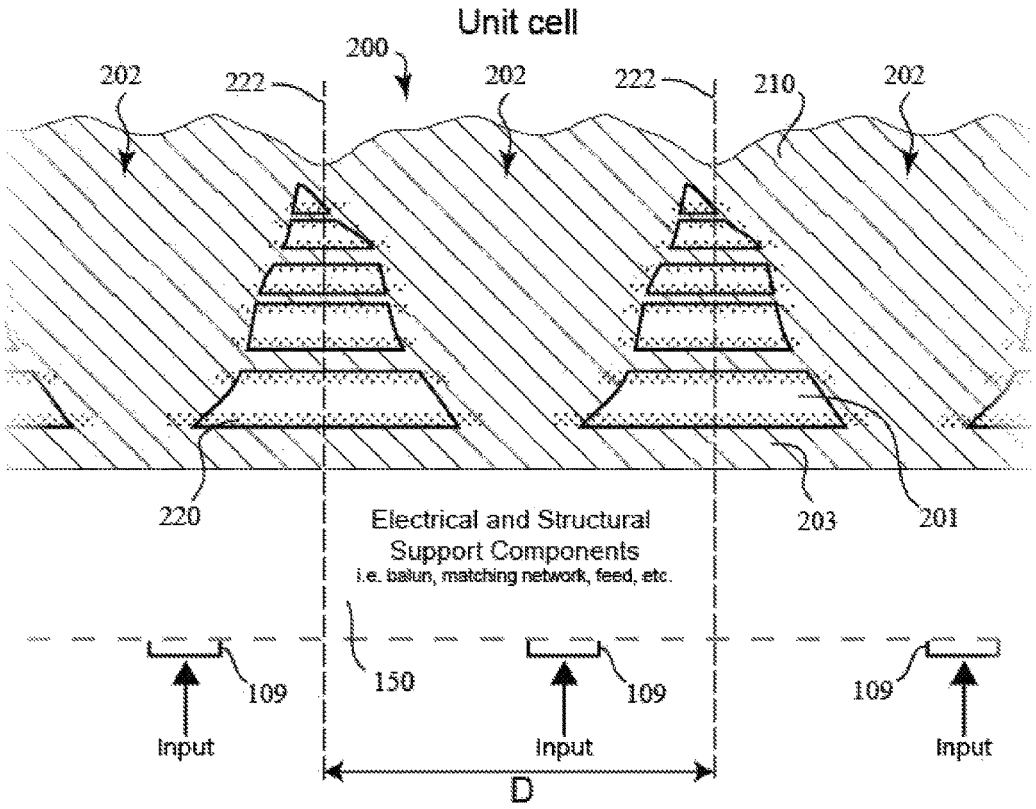
Figure 1E:
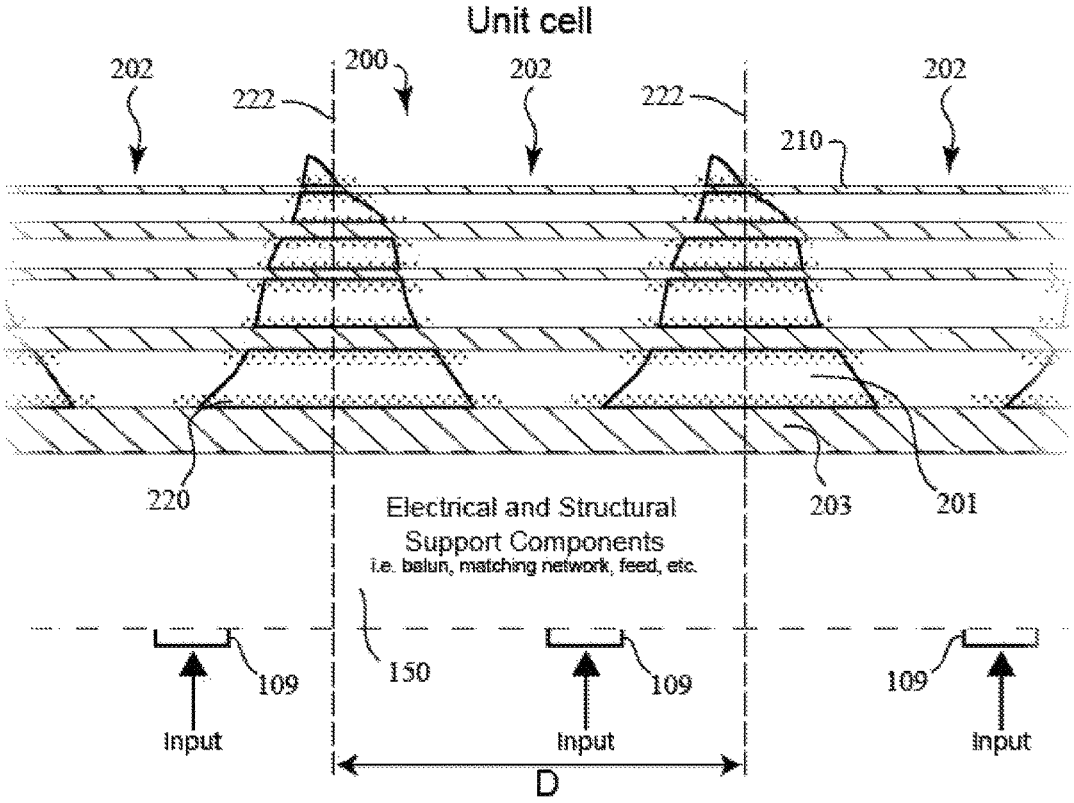
Figure 1F:
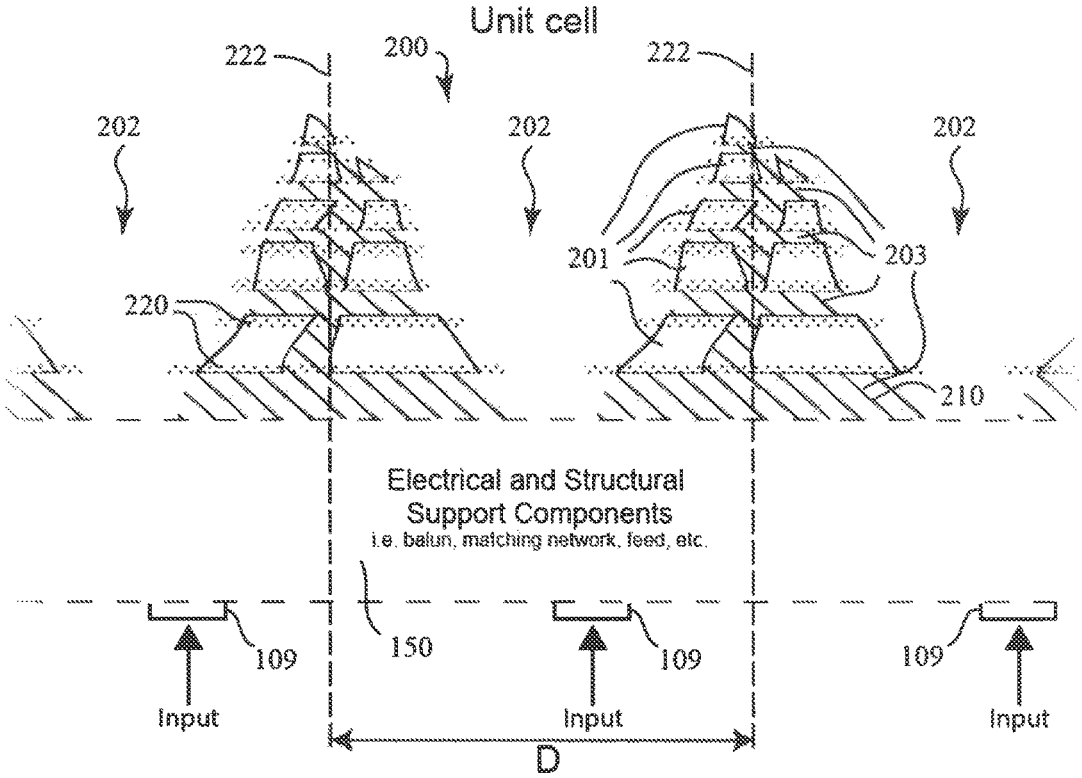

As previously mentioned, the various embodiments of the antenna elements 200 according to the invention can be electrically and structurally supported by a plurality of feeding, electrical, and mechanical components 150 as shown in FIGS. 1B-D. A benefit of the various aspects and embodiments of the invention is that the components of the support structure 150 used by legacy Vivaldi-type antenna elements 100 as shown in FIG. 1A, can also be utilized by the inventive antenna element to be backwards compliant with standardized wideband array hardware. The choice of feeding structure may vary as desired to involve balanced microstrip/stripline feeds terminated in quarter-wave stubs, direct unbalanced stripline/coaxial connection, or other variant options. A plurality of the antenna elements 200 can be provided to comprise a linear or planar array.

As noted above, another unique feature of aspects and embodiments of the antenna elements disclosed herein is that the radiator body 201 does not need to be electrically connected to the components 150, due to strong capacitive coupling that effectively allows current to flow at the frequencies of interest, effectively emulating the Vivaldi current distribution at the frequencies of interest (lower frequency band but not higher frequencies which are not necessary for the correct operation). Accordingly, some of the more popular embodiments of Vivaldi-type antenna elements will be specifically addressed in the following discussions as realistic comparisons although it is absolutely not limited to those embodiments.

ADDITIONAL EXEMPLARY EMBODIMENTS

Figure 2A:
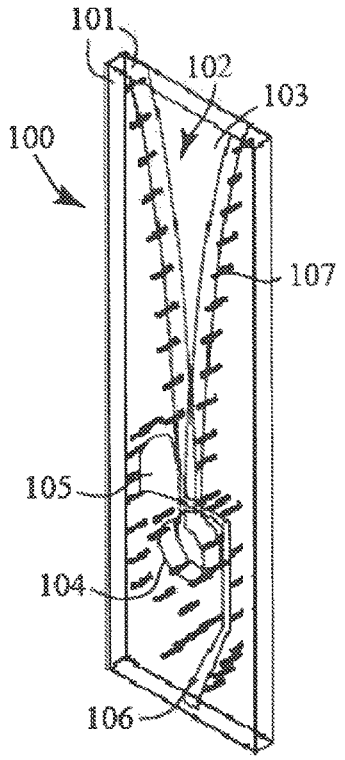
FIGS. 2A-B are illustrations of a typical stripline (triplate) Vivaldi antenna element and an all-metal embodiment of a Vivaldi antenna element, according to the prior art.
Figure 2B:
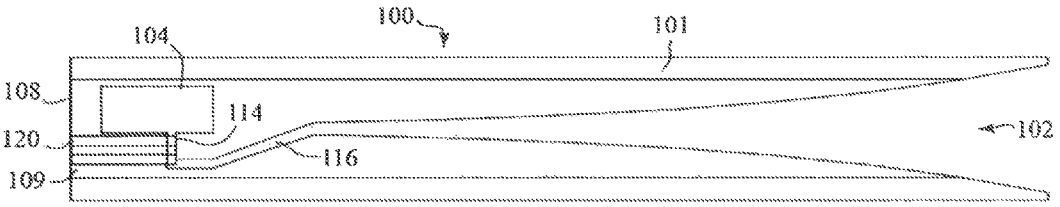

Printed circuit board (PCB) manufacturing is an appealing fabrication method of antennas due to its high-volume, low-cost production. An example of a prior-art Vivaldi antenna element implemented in stripline is shown in FIG. 2A and FIG. 2B is an all-metal embodiment of a Vivaldi antenna element, according to the prior art. The prior-art Vivaldi antenna element 100 implemented in stripline is shown as a comparative reference to highlight its contiguous antenna body 101 tapered slot 102, transmission medium 103, connected to electrical/structural components 150 (not labelled), which includes a slot-line cavity 104, a quarter-wave stub 105, and a strip-line balun 106, that is also known as Knorr balun. The structure further includes 107, bottom surface 108, feed port 109, and a coaxial cable 120.

Figure 3A:
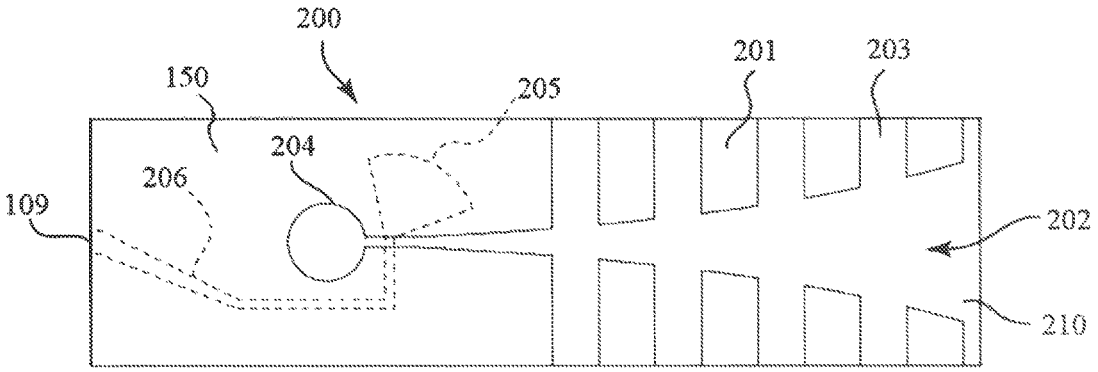
FIG. 3A is a side-view illustration of an antenna element according to the invention embodied as a microstrip embodiment.
Figure 3B:
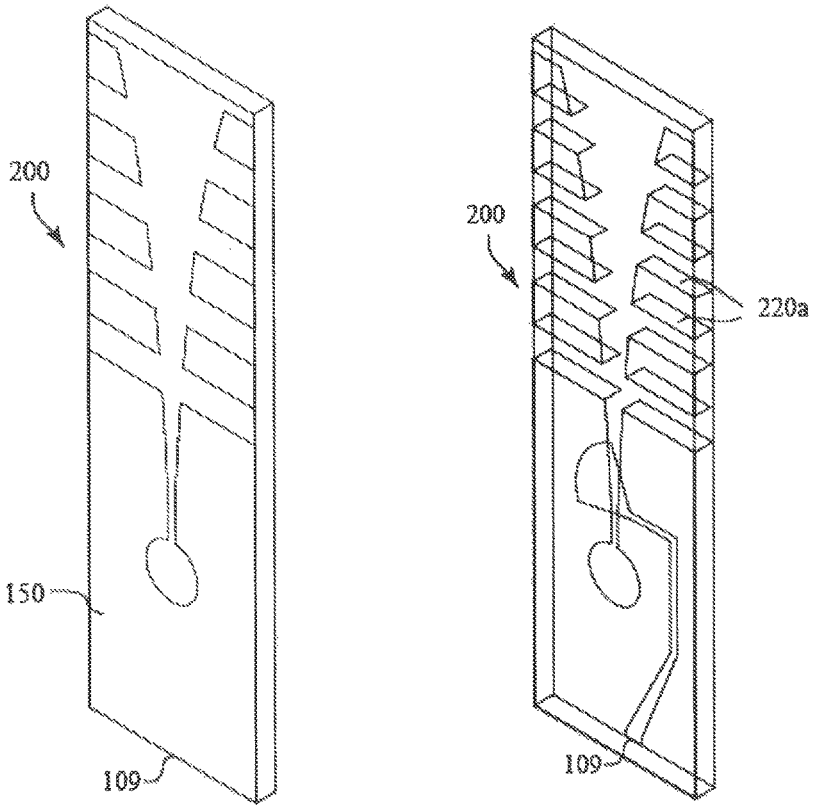
FIG. 3B depicts opaque/transparent isometric perspective views of the microstrip embodiment of FIG. 3A, respectively.
Figure 4A:
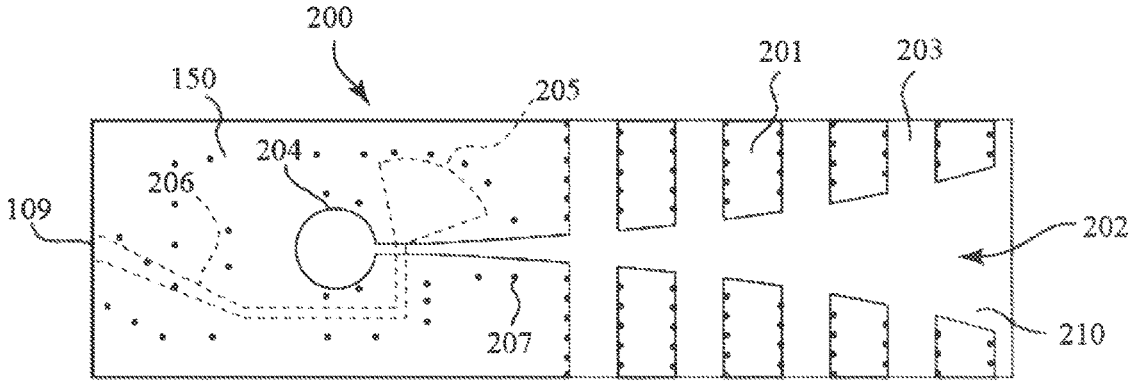
FIG. 4A is a side-view illustration of an antenna element according to the invention embodied in stripline (triplate) and plated vias.
Figure 4B:
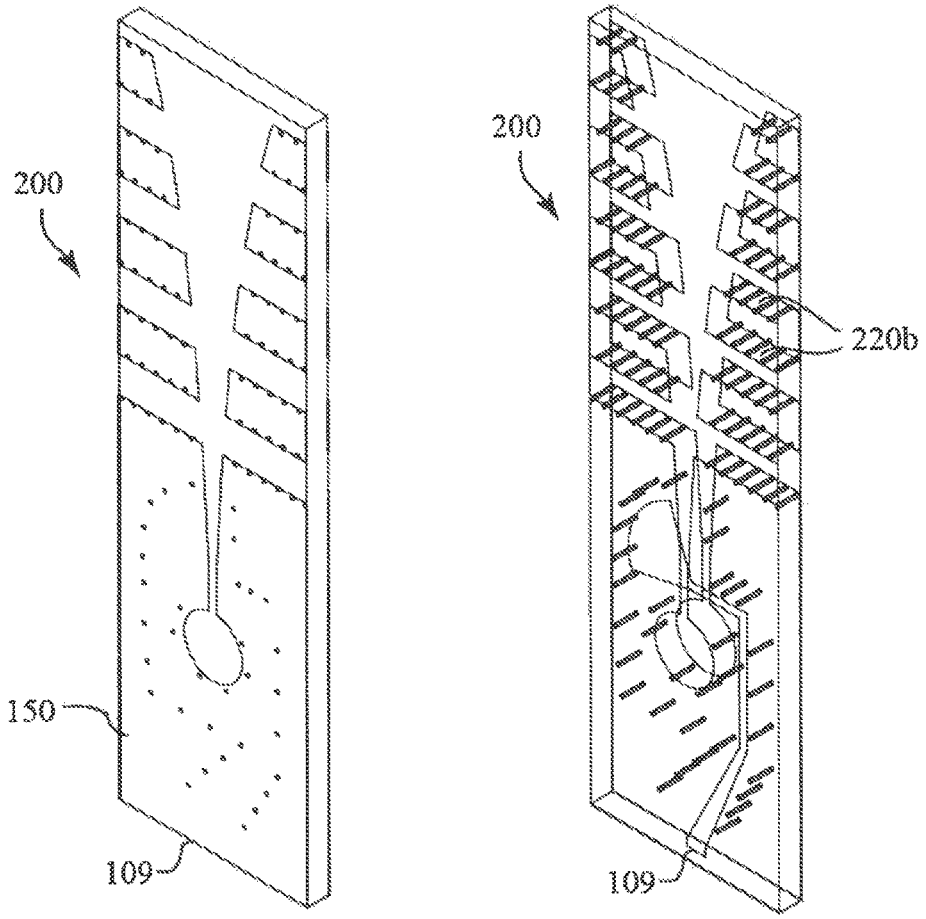
FIG. 4B depicts opaque/transparent isometric perspectives of the stripline embodiment of FIG. 4A, respectively.
Figure 4C:
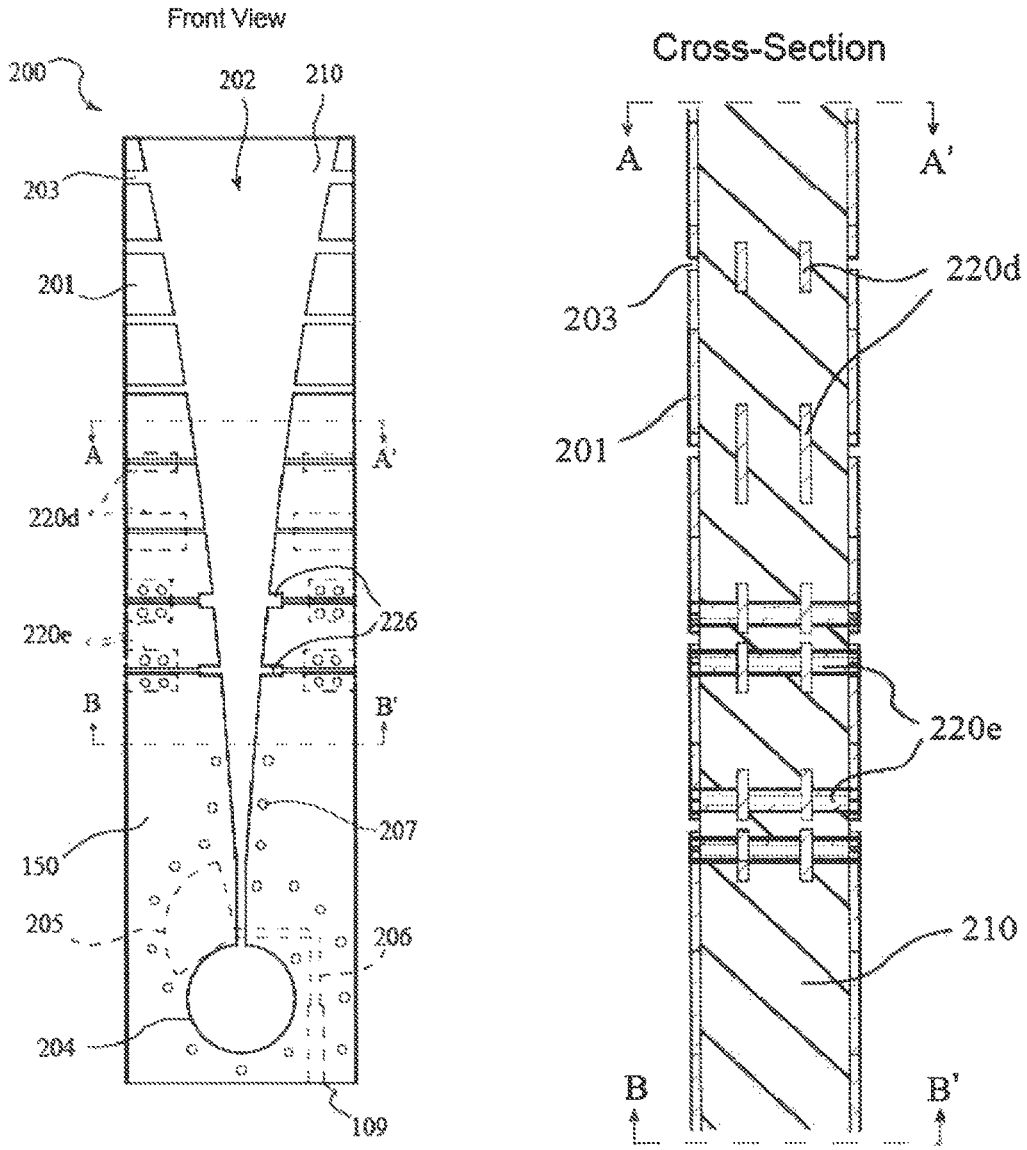
FIG. 4C depicts front and cross-sectional views of the stripline embodiment of FIG. 4A, respectively, that incorporate parasitic plates inside to enhance the coupling between fin slices.

One embodiment of an inventive antenna element 200 based on PCB fabrication is shown in FIGS. 3A-B and FIGS. 4A-C for microstrip and stripline (tri-plate) topologies, respectively. FIG. 3A-B are a side-view illustration and an opaque/transparent isometric perspective view of a microstrip embodiment, respectively. FIG. 4A is a side-view illustration, FIG. 4B depicts an opaque/transparent isometric perspective view and FIG. 4C depicts front and cross-sectional views of an antenna element embodied in stripline, respectively. The disconnected metal components of the radiator body 201 in the tapered slot region 202 are separated by the gap regions 203 within the antenna element 200 that is supported by a metal structural base 150 containing the slot-line cavity 204 and electrical grounding for the element. The feeding incorporates a microstrip balun 206 terminated into a quarter-wave stub 205 printed upon the opposite side of the mechanically supporting medium 210.

Figure 5A:
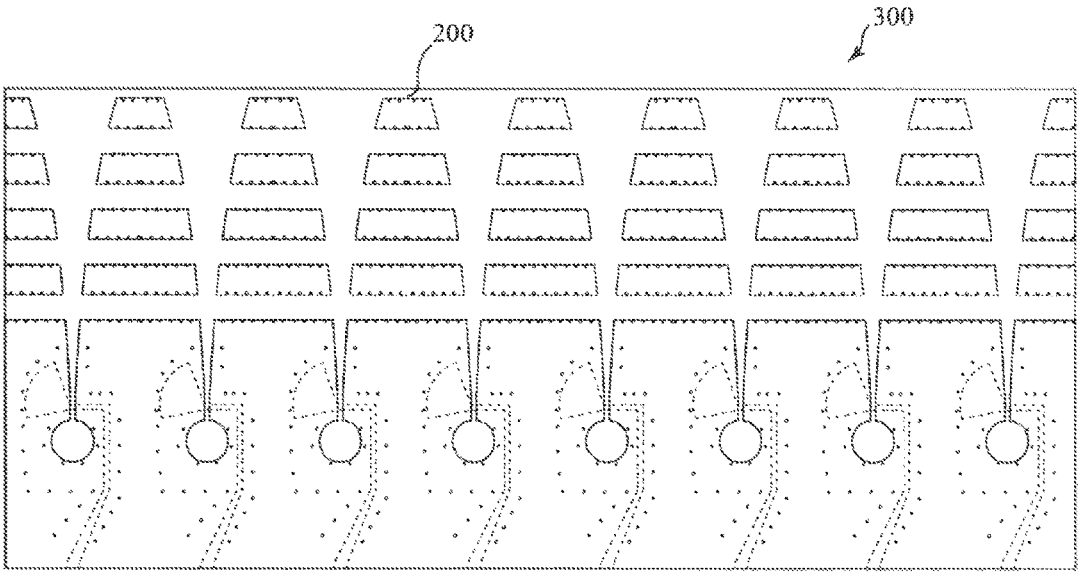
FIGS. 5A-B show an illustration of a linear single polarized array of antenna elements according to the invention in a stripline (triplate) embodiment from a side view and a transparent isometric view, respectively.
Figure 5B:
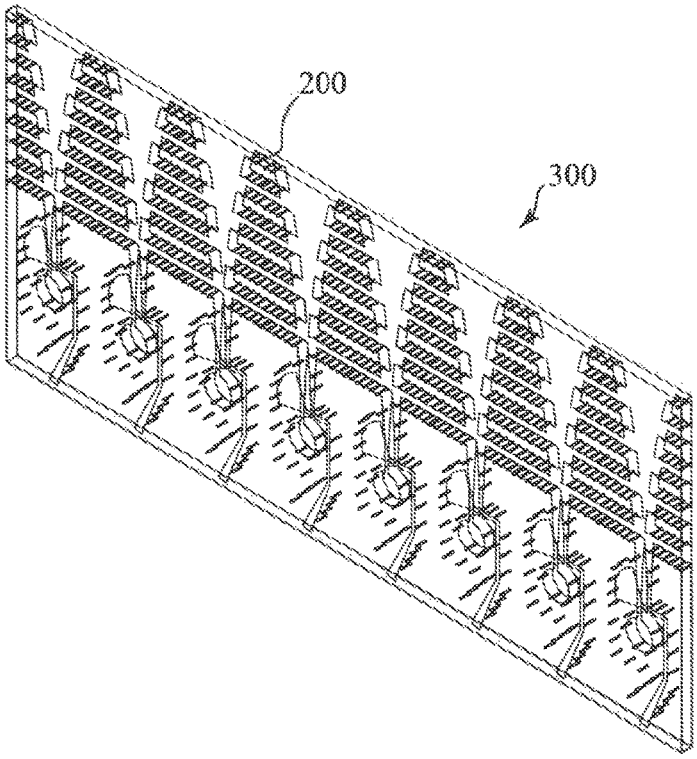

Edge-plating 220*a* is utilized as one method to enhance capacitance for coupling augmentation between two adjacent disconnected metallic components of radiator body 201. For the stripline embodiment of FIGS. 4A-B, metallic vias 207 are positioned at both horizontal edges of the slice to embody the capacitive coupling enhancing structure 220*b* between the vertical disconnected metal components of the radiator body 201, although edge-plating may also be used. Additionally, FIG. 4C highlights other possible capacitive enhancing structures like that of 220*d* and 220*e*, where a single or plurality of parallel plate(s) are located between the disconnected metal components 201 of the radiator body that are shown to be disconnected or connected with vias to the metallic radiator body components. These parallel plate capacitance enhancing structures could reside between or outside the disconnected metallic components of the radiator body 201, or extend across the slot. Inward notches 226 into the disconnected metallic components of the radiator body 201 are also seen within FIG. 4C, which is a front view, in which the capacitive coupling is focused upon a selective region. The amount, length, and width of these capacitive enhancing structures are important design parameters that affect both high-end VSWR and cross-polarization rejection. An example of a linear array 300 of the antenna element of FIGS. 4A-4C is depicted in FIGS. 5A-B, and this can be translated into a dual-polarized configuration by orthogonally interweaving linear arrays to the linear array 300.

Figure 6A:
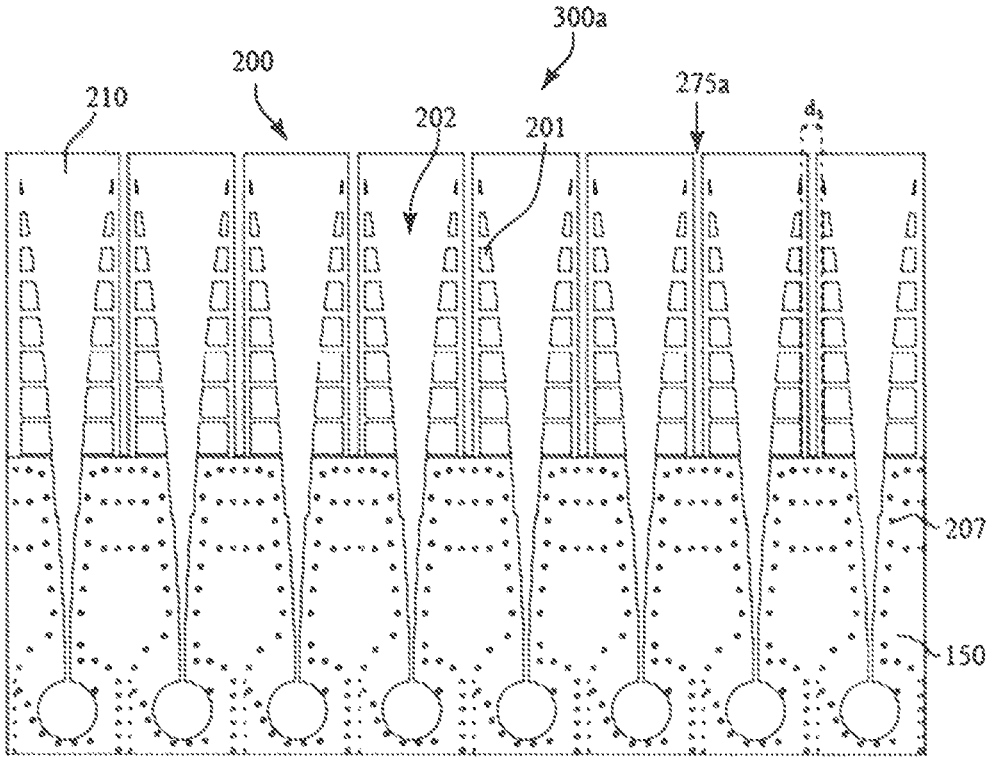
FIGS. 6A-B are illustrations of an antenna element according to the invention in which metallic disconnected components are separated and exclusive individual cuts are made in two separate linear arrays, finally forming a dual-polarized array configuration as illustrated in FIG. 6C.
Figure 6B:
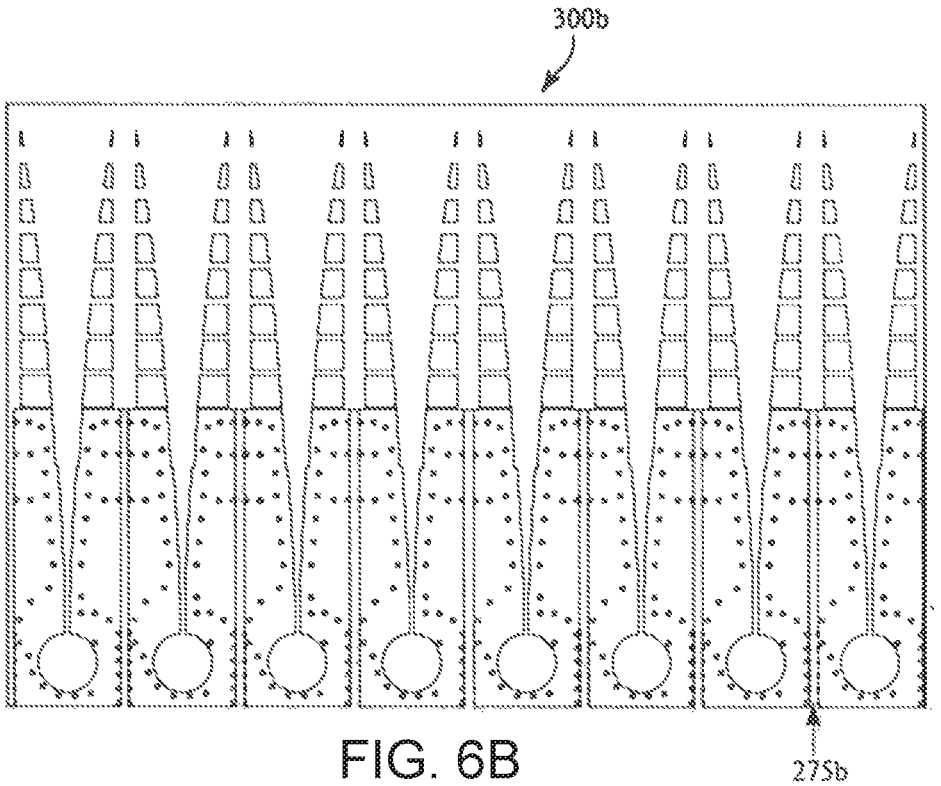
Figure 6C:
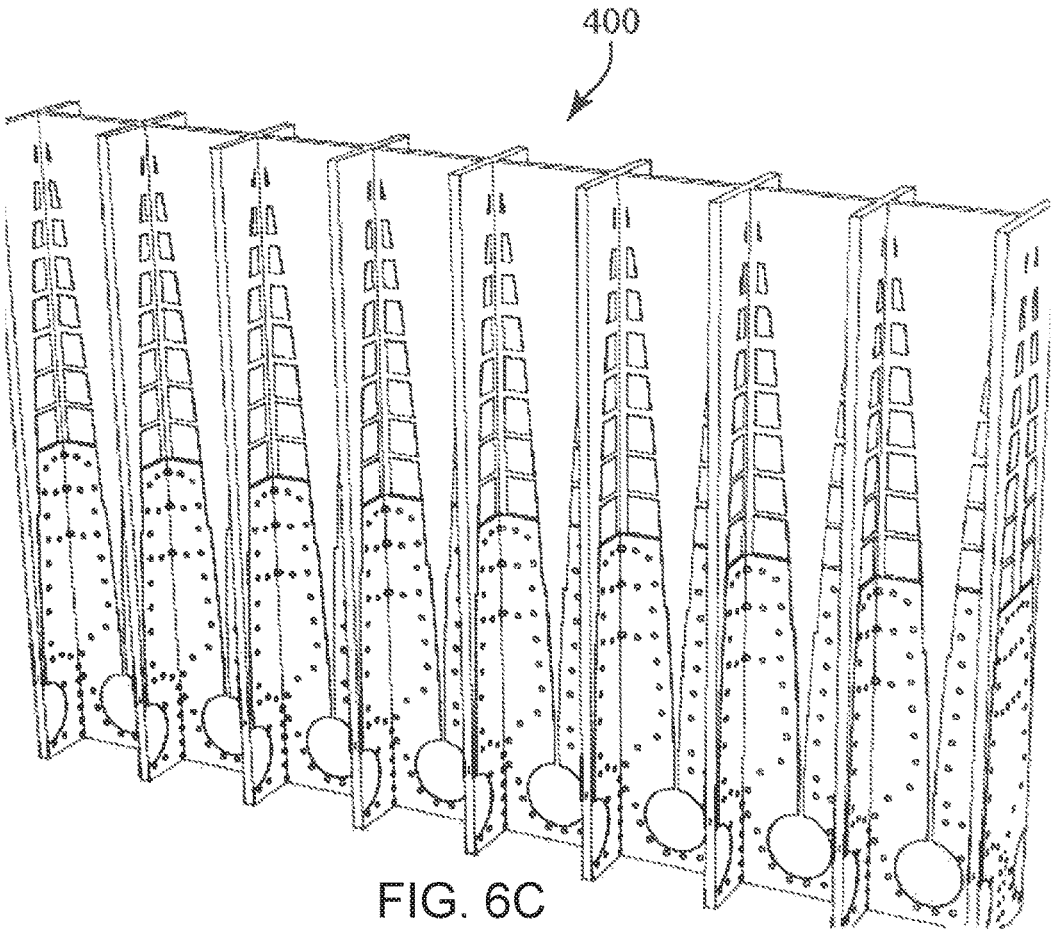

A noteworthy variant of the inventive antenna element and array for a more convenient fabrication and assembly process, especially for dual-polarized configurations, is illustrated in FIG. 6A-B. In this geometry, the disconnected metallic components 201 are conductively split and separated by a distance $d_s$ to accommodate for inward cutting 275*a* and 275*b* to be made into the mechanically supporting medium 210. In this sense, the linear arrays 300*a* and 300*b* of FIG. 6A-B respectively have appropriate inward cuts 275*a* and 275*b* to orthogonally interweave with one another to form a dual-polarized array 400 like that illustrated in FIG. 6C. In this manner, no electrical conducting connection is required between orthogonal disconnected metal components 201 and metallic vias 207 are not necessary for adjoining any disconnected metal components 201. This is a major benefit as the amount and difficulty of soldering needed to enforced electrical conduction between original polarized cards for this architecture is dramatically reduced. When this benefit is combined with the associated reduction in the number of metallic vias, results in faster, lower risk and lower cost fabrication.

Figure 7A:
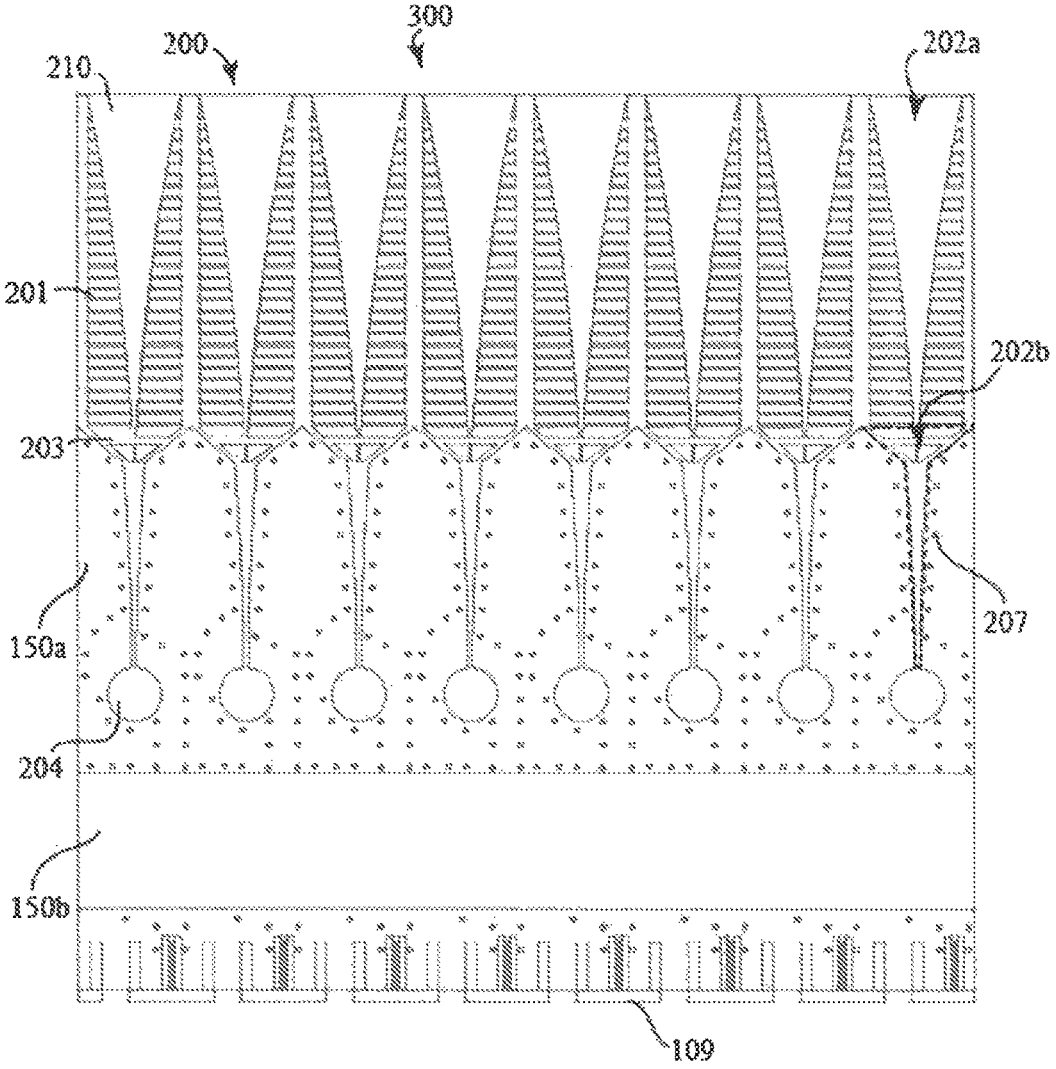
FIGS. 7A-B are the single-polarized linear array side view and the single-polarized planar array perspective view illustrations of an antenna element according to the invention in which metallic disconnected components are separated and exclusive individual cuts and with an antenna body protruding into a sliced region.
Figure 7B:
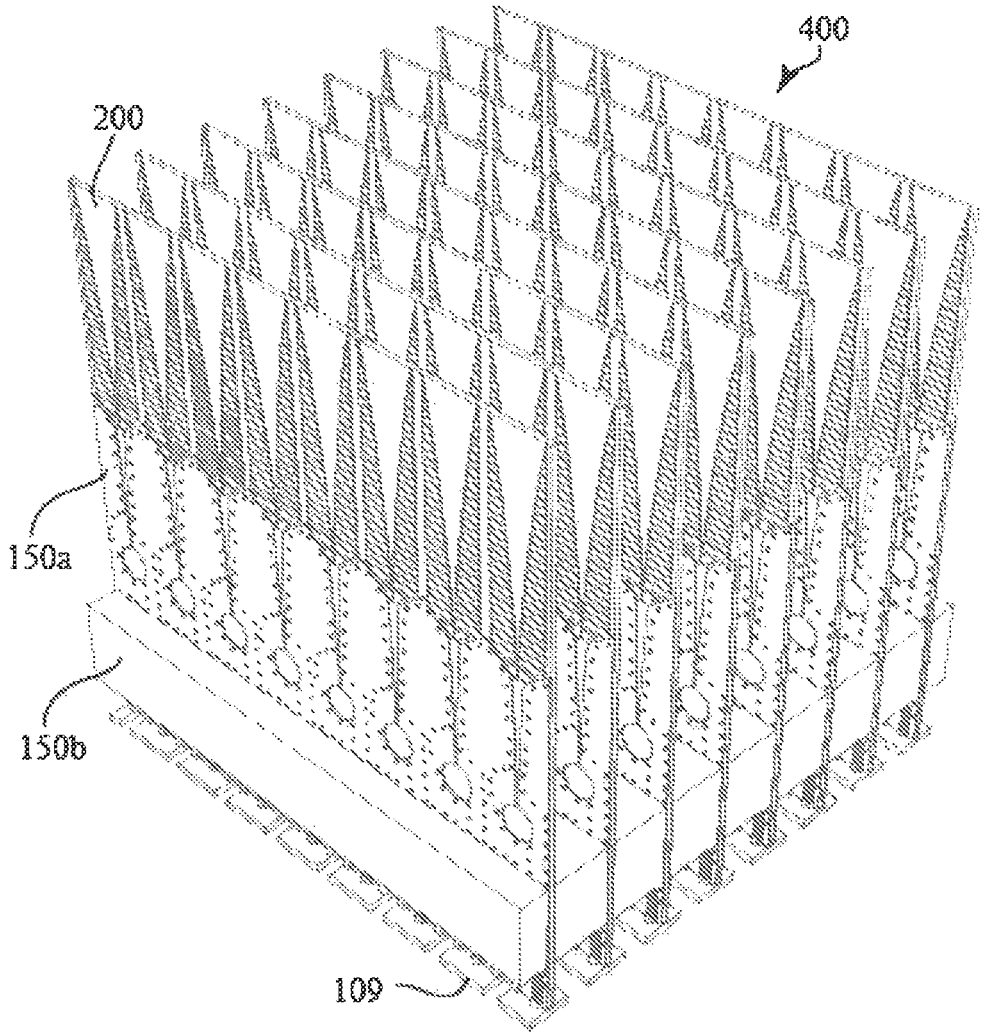
Figure 7C:
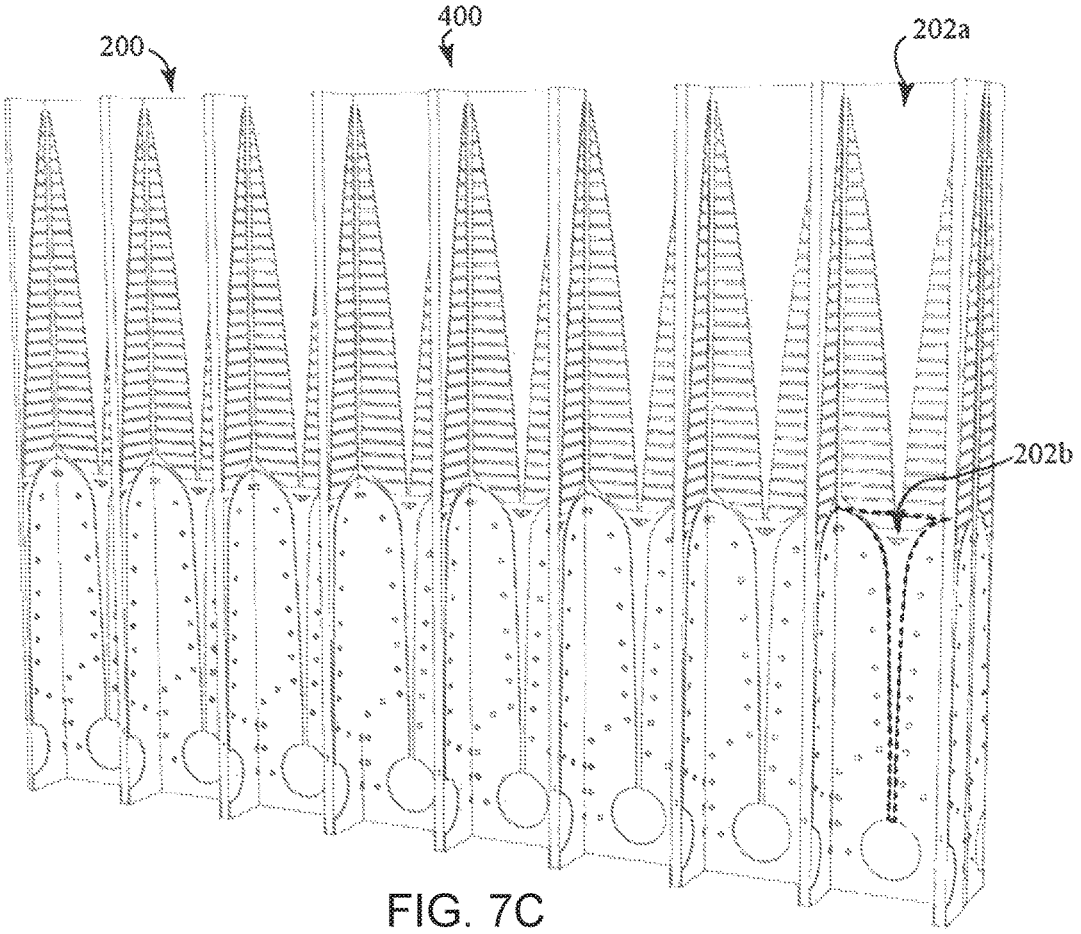
FIG. 7C illustrates the antenna element of FIGS. 7A-B embodied as a dual polarized array showing only a single row of the dual polarized planar array.

Further techniques are applied in the linear array of FIG. 7A, and further embodied as a dual-polarized array in FIG. 7B to highlight the possibility of the antenna body 150*a* forming its own tapered slot region 202*b* to integrate with a sliced region (as opposed to the standard straight-line cuts depicted throughout previous illustrations). This embodiment of the antenna element 300 is further supported by blocks 150*b* to provide mechanical stability. Another dual-polarized arrangement is shown in FIG. 7C, with a more curvy tapered slot region 202*b*. It is appreciated that although this embodiment is conveyed through a PCB-based architecture, it is certainly not limited to this geometry and may generally be applied across a plurality of methods (including hybrid technology builds) with or without the inward cutting 275.

Figure 7D:
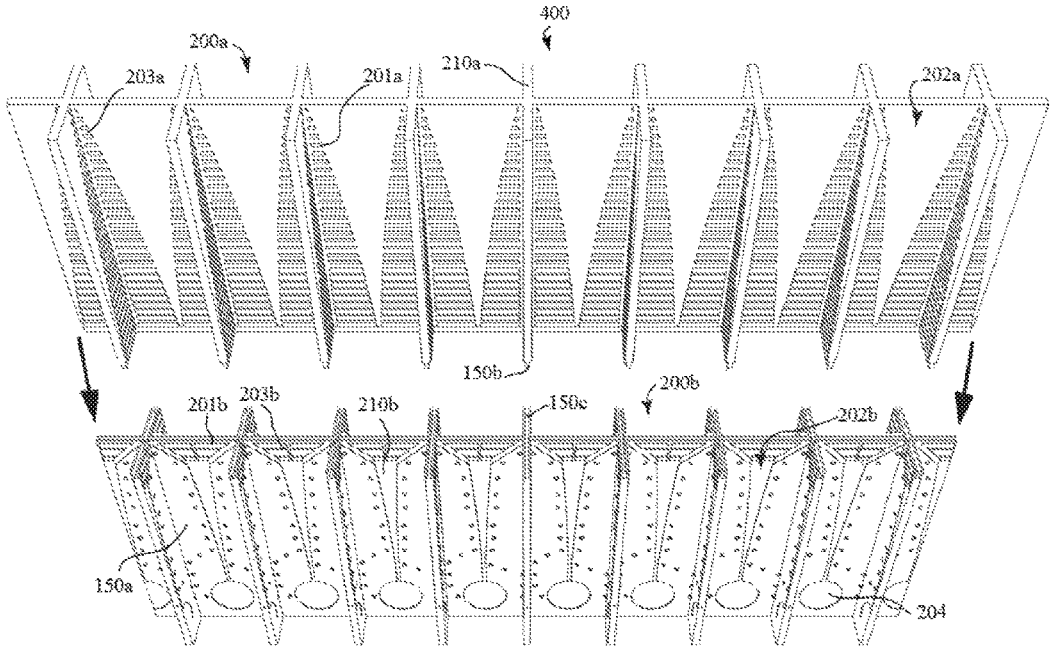
FIG. 7D illustrates the antenna element comprised of multiple antenna element sections including a top antenna section and a bottom antenna section.
Figure 7E:
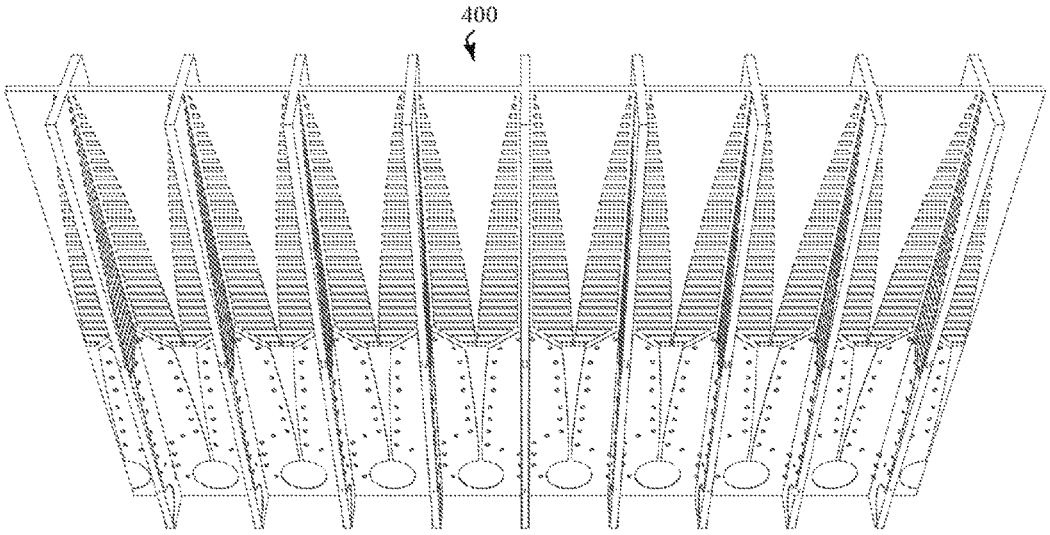
FIG. 7E illustrates the top and bottom antenna sections adjoined to form a single row of dual-polarized elements.
Figure 7F:
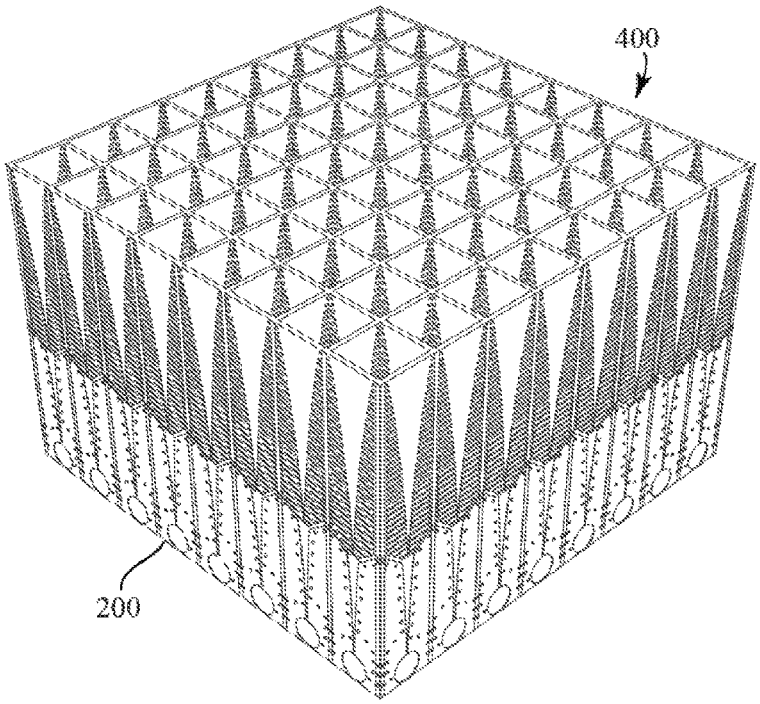
FIG. 7F illustrates the antenna sections adjoined to form an array in an 8×8 dual-polarized assembly of antenna elements.
Figure 7G:
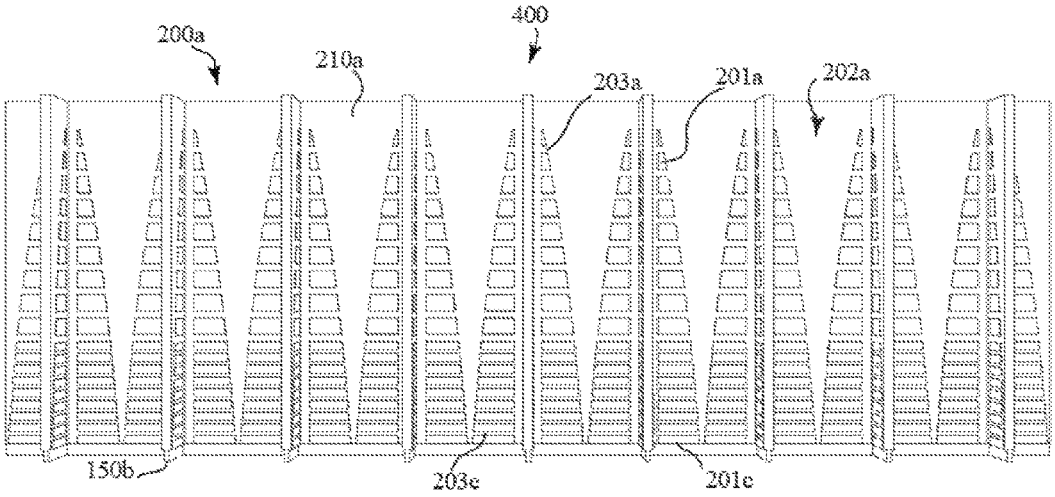
FIG. 7G illustrates that the width, shape, and periodicity of the disconnected metal components in the top antenna element section may take on a plurality of embodiments.

The antenna element 200 may comprise multiple antenna element sections, such as a top portion antenna element section 200*a* and bottom section 200*b* as illustrated in FIG. 7D. It is appreciated that these two sections as illustrated in FIG. 7D may be adjoined in a plethora of methods, and by way of example a "tongue-and-groove" is highlighted as one such structure with support components 150*b* and 150*c*. It is noted that disconnected metal components 201*a* and 201*b* can be in separate regions. Together, the sections can form the antenna element and array as shown in FIG. 7E, which are combined in a single row of dual-polarized elements and FIG. 7F as shown in FIG. 7F as an 8×8 dual-polarized array assembly. Furthermore, referring to FIG. 7G, it is appreciated that the width, shape, and periodicity of disconnected metal components 201*a* and 201*c* in the antenna element section 200*a* may take on a plurality of embodiments. This multiple section embodiment is advantageous because it leads to reduced PCB card bending from the top or bottom PCB cards, and makes easier to perform soldering of orthogonal card in the bottom section 200*b* of dual polarized antenna arrangements. It is further appreciated that although these structures are illustrated as embodied in a PCB-based architecture, the herein described embodiments are certainly not limited to this geometry and may generally be applied across a plurality of structures (including hybrid technology builds) with or without inward cutting 275 as has been described herein.

Another embodiment of an inventive antenna element and array is based on an all-metal Vivaldi arrays that is produced with electrical discharge machining (EDM) of stock metal e.g. aluminum, or additive manufacturing (3D printing) fabrication. This is an attractive means of manufacturing as it enables an all-metal composition of the antenna element body for high-power usage and avoids individually soldering (conductively connecting) orthogonal elements or orthogonal element cards together. An all-metal Vivaldi of this type is shown as a comparative reference to FIG. 2B with a contiguous antenna body 101 and respective electrical/structural support components 150.

Figure 8A:
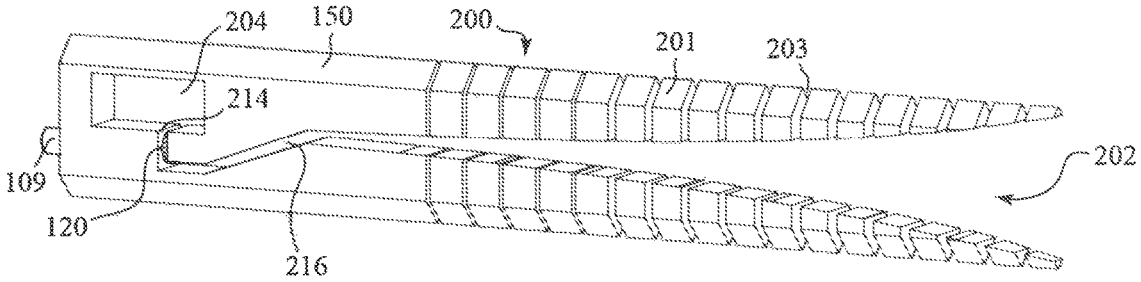
FIGS. 8A-B are illustrations of an antenna element embodied as all-metal with gap regions filled with air and a non-conductivity/low-conductivity dielectric material, respectively.
Figure 8B:
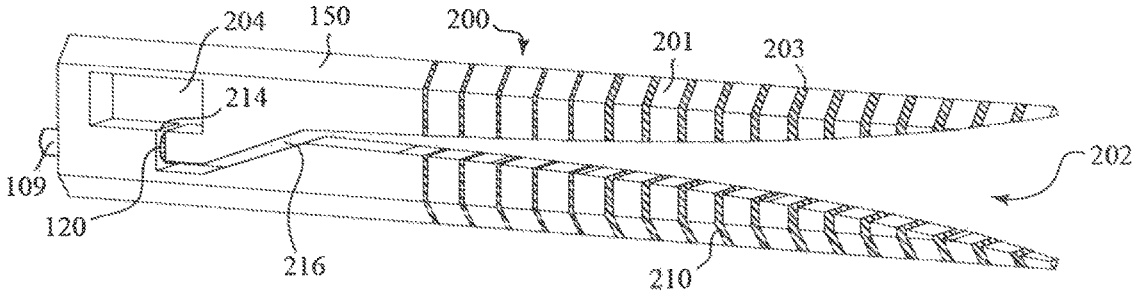
Figure 9:
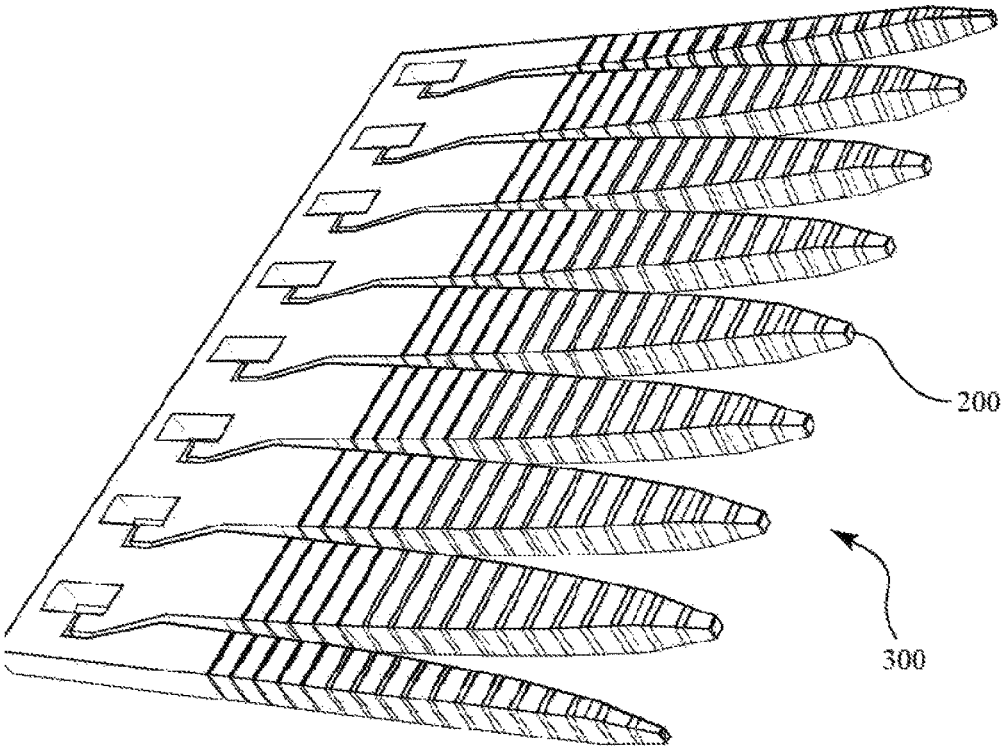
FIG. 9 illustrates an isometric view of a linear array of antenna elements embodied as all-metal with gap regions filled with air or non-conductivity/low-conductivity dielectric material.
Figure 10:
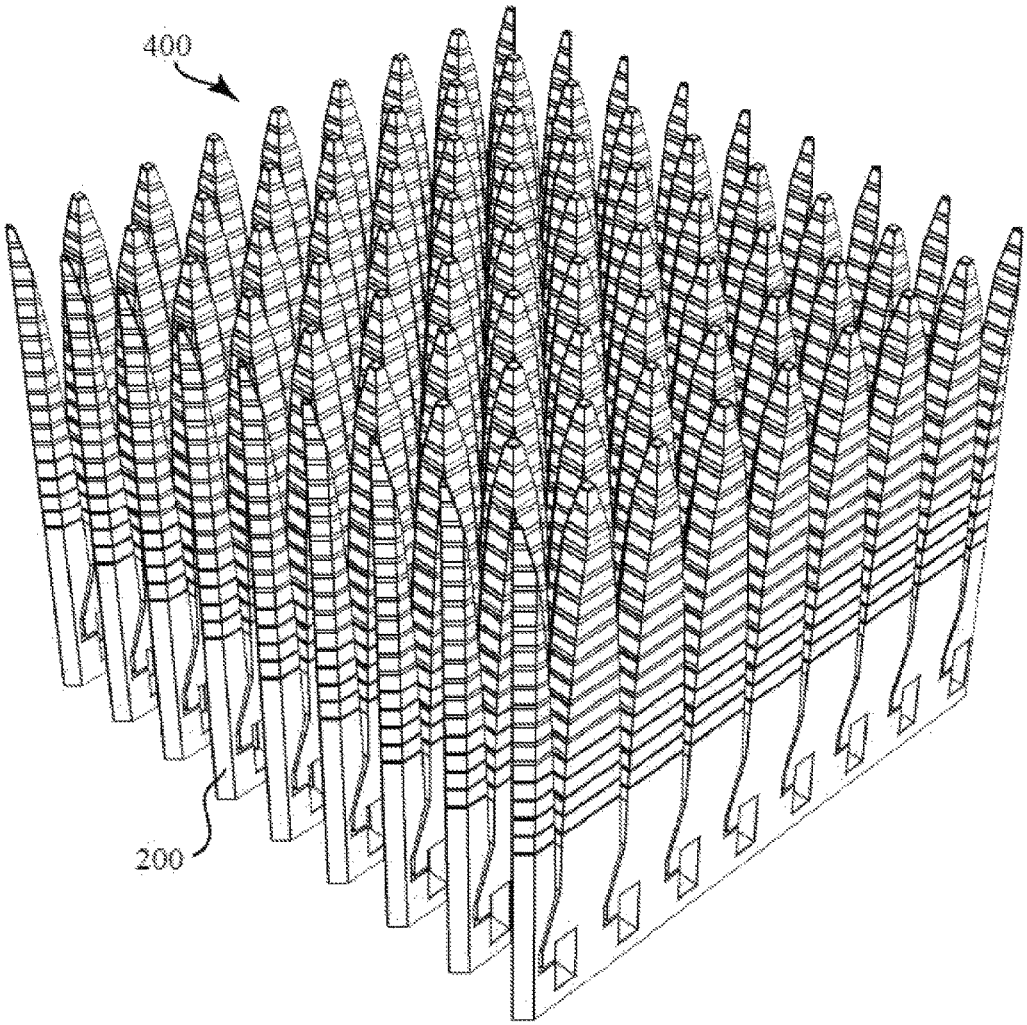
FIG. 10 is an isometric view of a dual polarized array of antenna elements embodied as all-metal with gap regions filled with air or non-conductivity/low-conductivity dielectric material.

An all-metal Vivaldi embodiment of the inventive antenna element 200 is illustrated in FIGS. 8A-8B. Metallic disconnected components of radiator body 201 are spaced by gap regions 203 to form a tapered slot region 202. The gap regions 203 are shown filled with a preferably non-conducting or low-conductivity material 210 such as dielectrics to provide spacing support for the metallic disconnected components of radiator body 201 in FIG. 6B. A single polarized linear array 300 of the antenna element according to the invention in this form is illustrated in FIG. 9 and extended into a single polarized planar array configuration 400 in FIG. 10.

As stated before, the antenna element according to the invention improves upon electrical performance with its inventive structuring and is capable of following more prominent fabrication guidelines used in Vivaldi-type architectures such as the above discussed all-metal antenna body version.

Figure 11A:
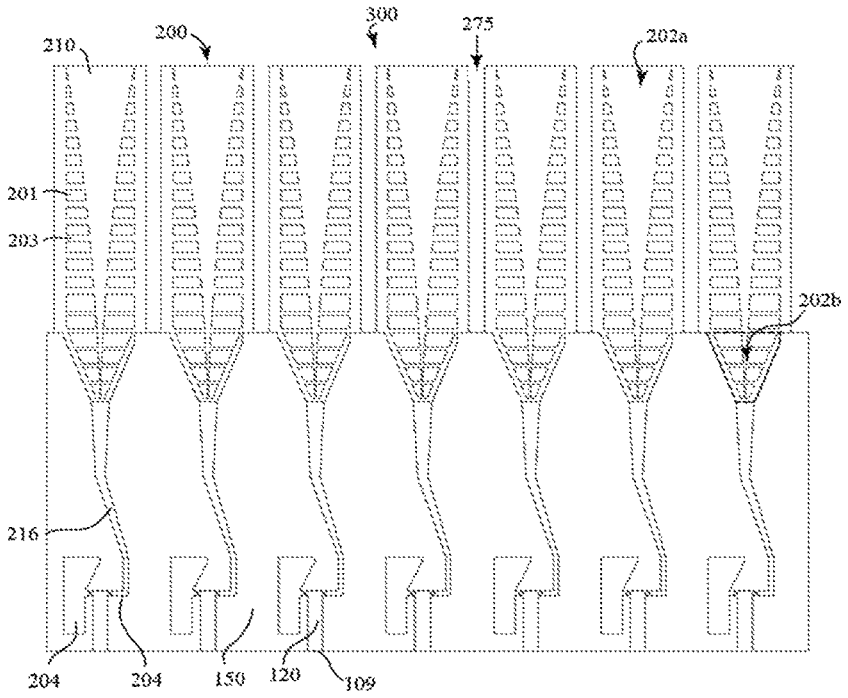
FIGS. 11A-B are illustrations of a 7-element linear array and a 7×7 dual-polarized array incorporating a hybrid design of PCB and all-metal fabrication.
Figure 11B:
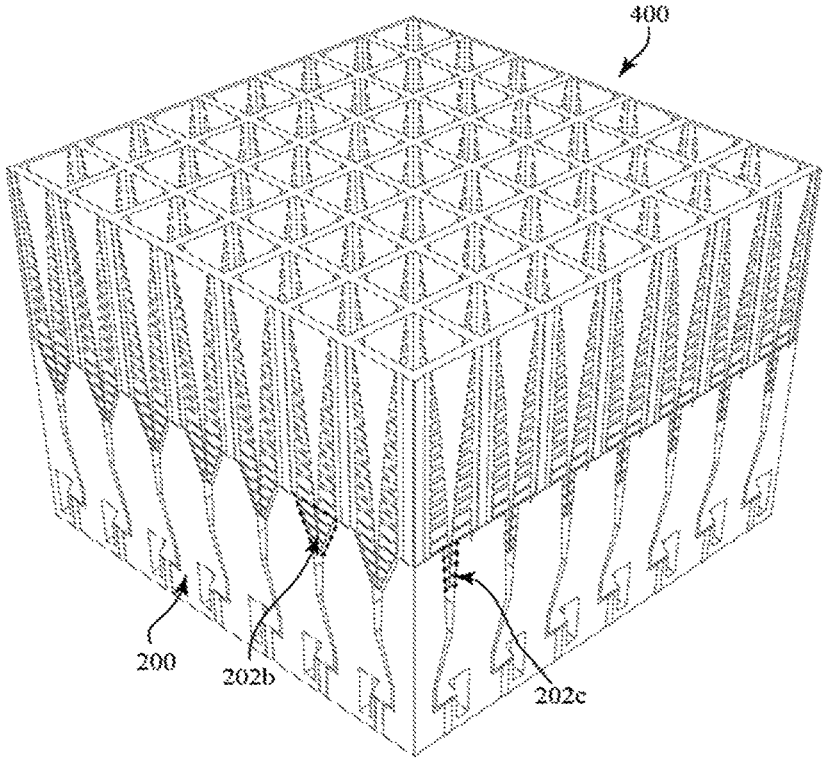
Figure 11C:
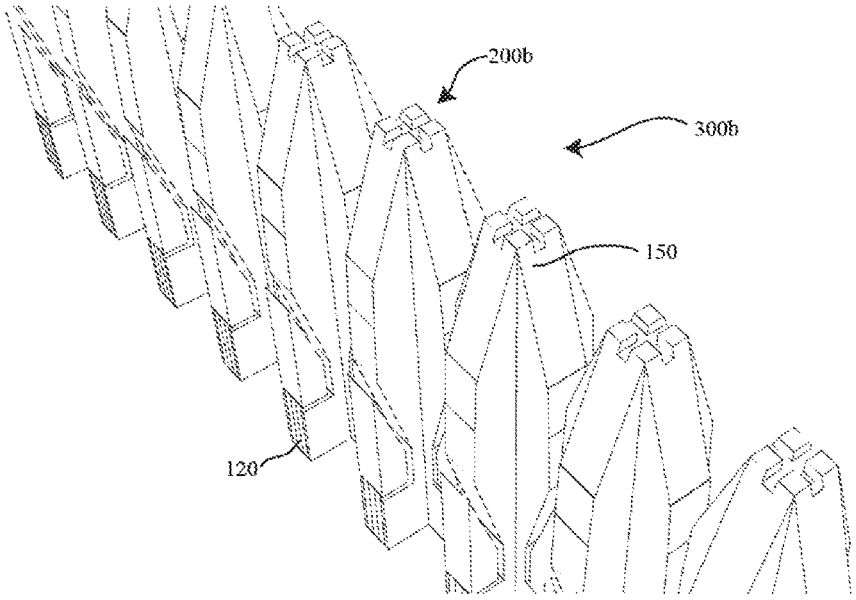
FIG. 11C-D illustrate the antenna element of FIGS. 11A-B comprised of multiple antenna element sections including a top antenna section as illustrated in FIG. 11D and a bottom section as illustrated in FIG. 11C.
Figure 11D:
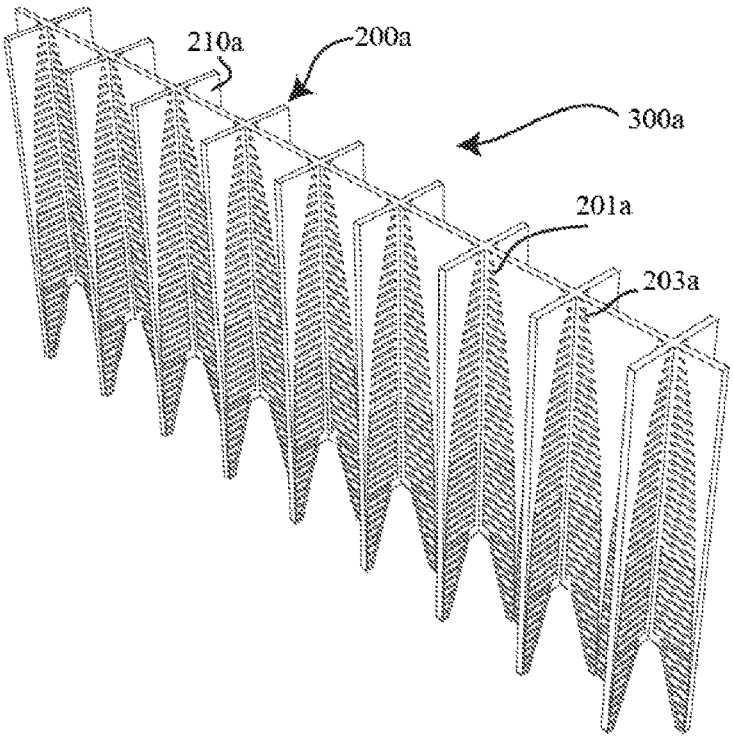
Figure 11E:
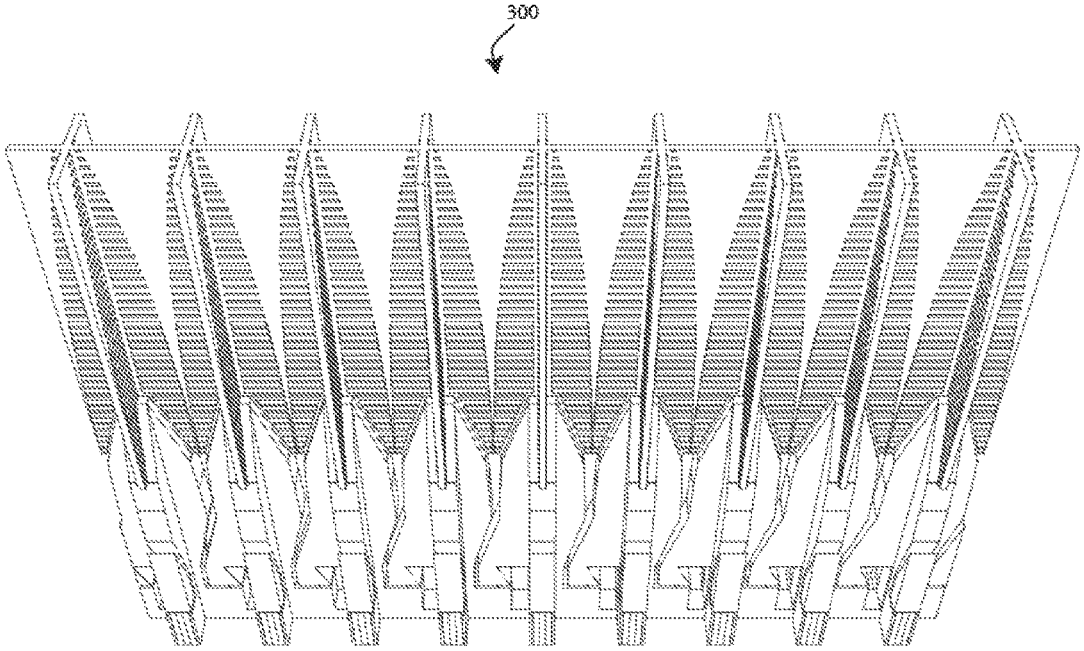
FIG. 11E illustrates the top and bottom antenna sections adjoined to form an array in a single row of dual-polarized elements.

It is appreciated that hybrid designs using various fabrication methods may also be constructed, such as by way of example (but not limited to) the case of a PCB and EDM all-metal hybrid linear array 300 like that illustrated in FIG. 11A. In this embodiment, a PCB section comprised of disconnected and vertically cut metallic components 201 within a supporting medium 210 are adjoined on top of an EDM all-metal antenna body 150. It is appreciated that the vertical cuts (electrically disconnected orthogonal polarized cards) make this PCB embodiment of the top section attractive. It is appreciated that the two sections may be independently designed, such as for example the tapered slot regions 202*a* and 202*b* of the PCB and EDM all-metal portions, respectively. The herein described option of inward cutting 275 is also incorporated in this embodiment for extrapolation to a dual-polarized configuration as in FIG. 11B. It is appreciated that the inward cutting 275 is not a necessity for all designs, and is merely shown as one possible structure that provides a simplified assembly method. It is also appreciated that the tapered slot regions 202*b* and 202*c* of the bottom EDM all-metal region can vary in shape as is illustrated in FIG. 11B, with one section embodying a linear taper and the orthogonal section embodying a straight section to further emphasize the design flexibility. As has already been stated, it is appreciated that a plurality of fabrication methods may be utilized to create a hybrid design, with independent tuning and mechanical flexibility allowed for all design parameters of each component. As has been discussed herein, it is appreciated that the antenna element making up the array 300, 400 may comprise multiple antenna element sections, such as a top portion antenna element section 300*a* as illustrated in FIG. 11D and a bottom antenna element section 300*b* as illustrated in FIG. 11C. It is appreciated that these two sections may be adjoined in a plethora of methods, and by way of example a "tongue-and-groove" structure 200*a* and 200*b* are illustrated in FIG. 11C-11D. The two sections 300*a* and 300*b* are combined via the "tongue-and-groove" structure 200*a* and 200*b* as illustrated in FIG. 11E.

Figure 12:
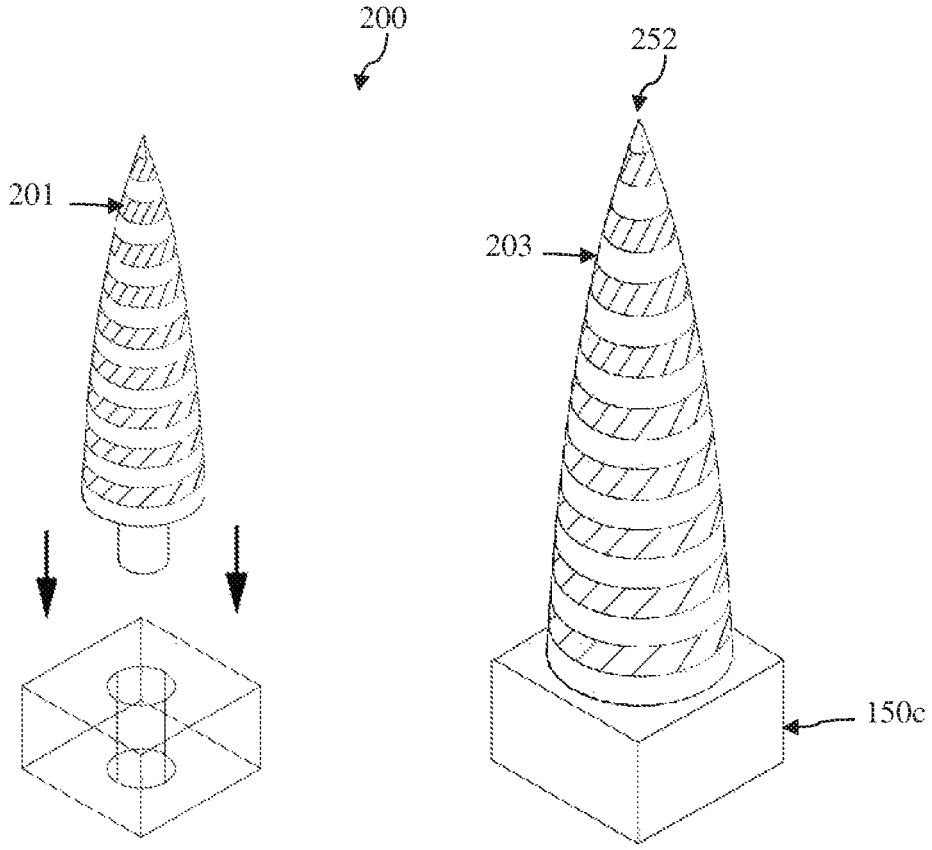
FIG. 12 is an isometric illustration of a body-of-revolution (BOR) antenna element embodiment.
Figure 13A:
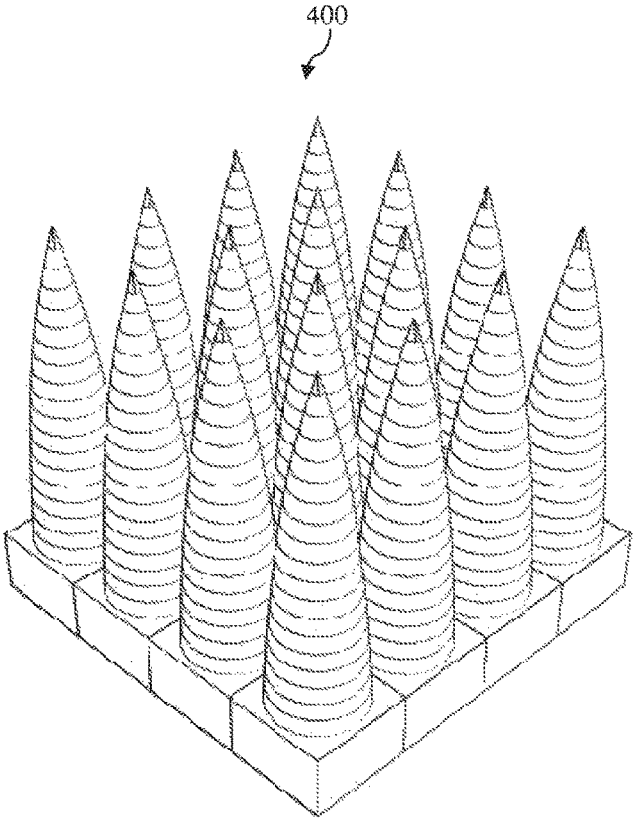
FIGS. 13A-B illustrate a 4×4 dual-polarized array of the BOR antenna element of FIG. 12.
Figure 13B:
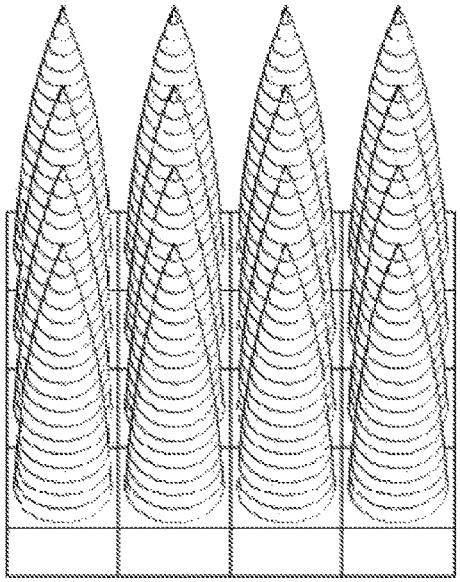

Another dual polarization embodiment comprising body of revolution (BOR) antenna elements having the shape of a tapered cone 252 like that shown in FIG. 12 can be used as modular Vivaldi alternatives where the inventive antenna element 200 can be fastened to a base 150*c* that contains feeding, baluns, matching, and/or structural components. Like that of other embodiments disclosed herein, the inventive antenna element 200 includes a disconnecting radiator body 201 with inventive gap regions 203. These BOR elements can be arrayed into a dual-polarized planar array configuration 400 as shown in FIGS. 13A-B.

Figure 14:
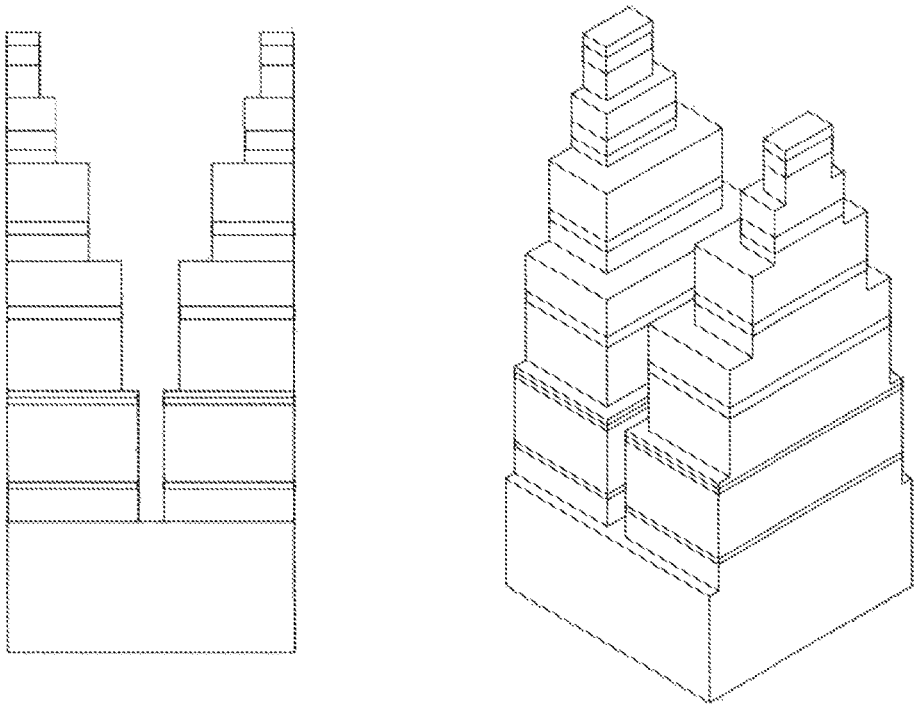
FIG. 14 depicts views of a stepped notch antenna element with arbitrary feeding and structural support.
Figure 15A:
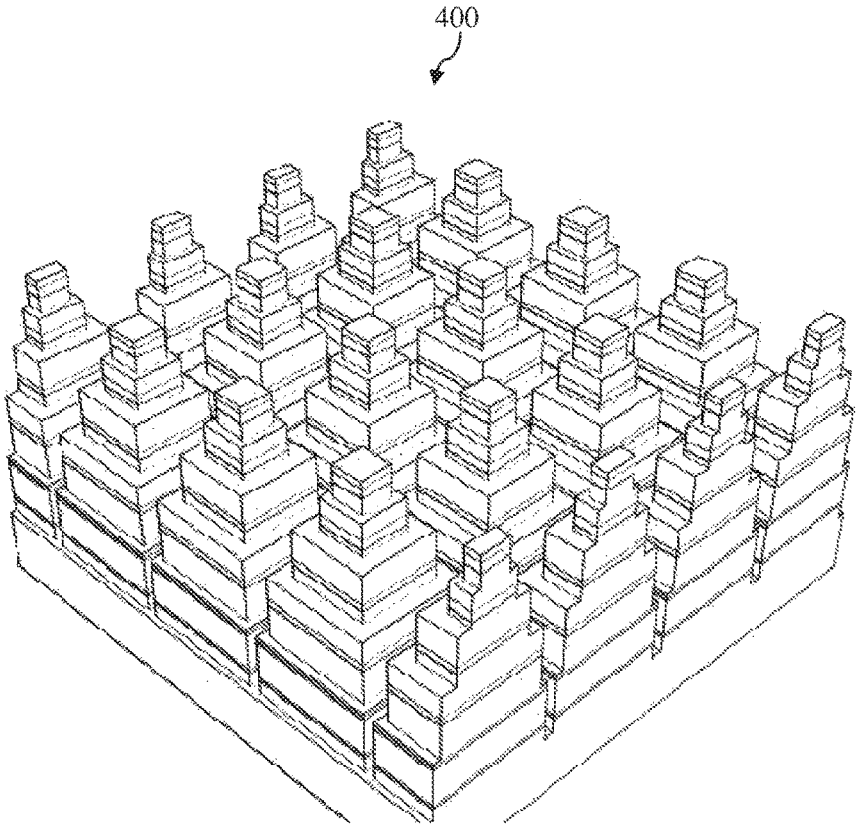
FIGS. 15A-B illustrate a perspective and side view, respectively, of a 4×4 dual-polarized array of the stepped notch embodiment of the antenna element according to FIG. 14.
Figure 15B:
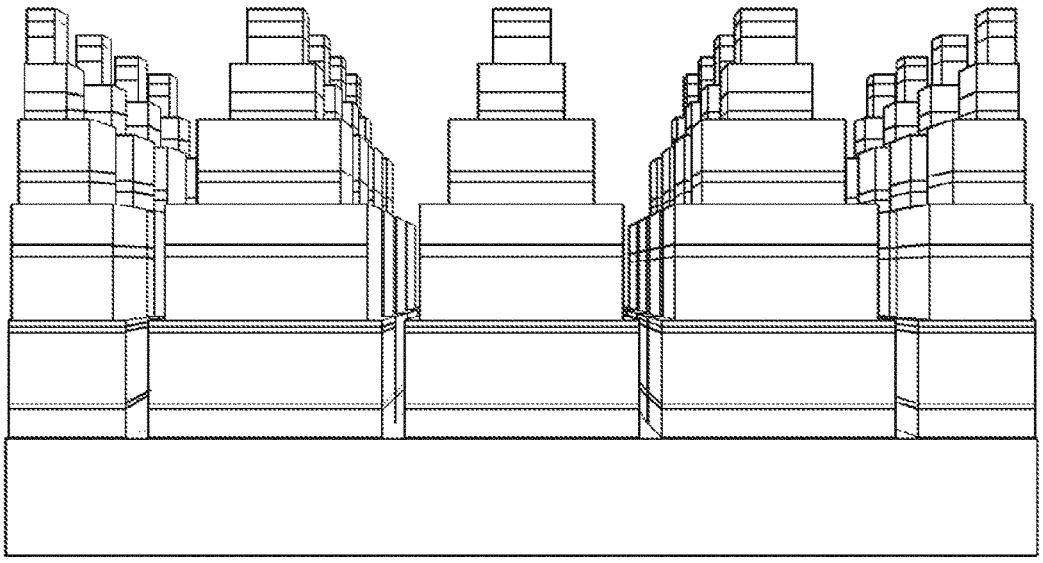

Another embodiment of an inventive antenna element according to this disclosure can be in the form of stepped notches 402 is illustrated in FIG. 14. One difference between stepped notches and previously discussed Vivaldi antenna elements is that the shape of the taper is now stepped upwards in flat segments, rather than a smooth taper. The antenna element 200 according to this embodiment invention may thus be embodied in the form as depicted in FIG. 11, and then is applied towards a 4×4 dual-polarized planar array 400 as an example in FIGS. 15A-B.

Figure 16:
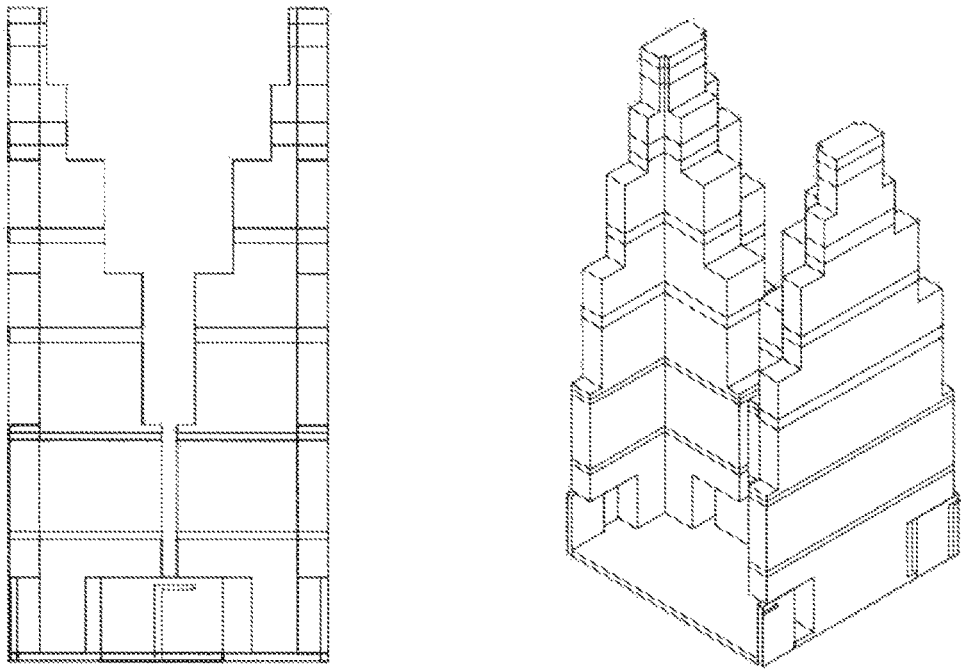
FIG. 16 depicts side and perspective views of a "Mecha-Notch" based antenna element according to one embodiment.
Figure 17A:
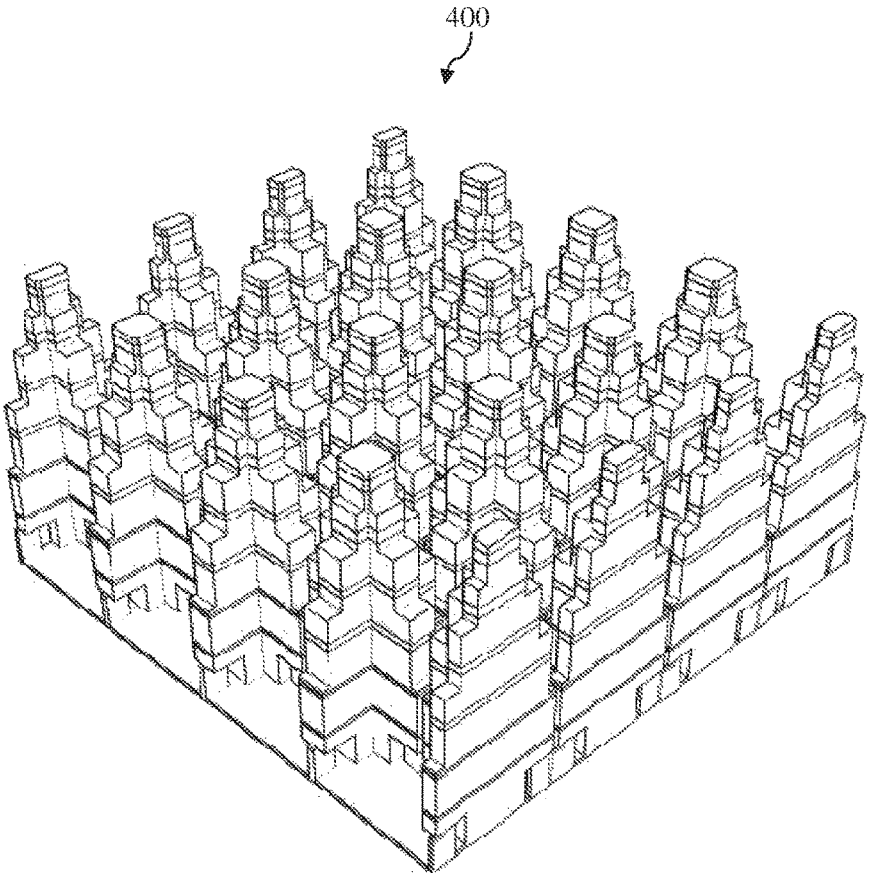
FIGS. 17A-17B illustrate perspective and side views, respectively, of a 4×4 dual-polarized array of the "Mecha-Notch" embodiment of the antenna element of FIG. 16.
Figure 17B:
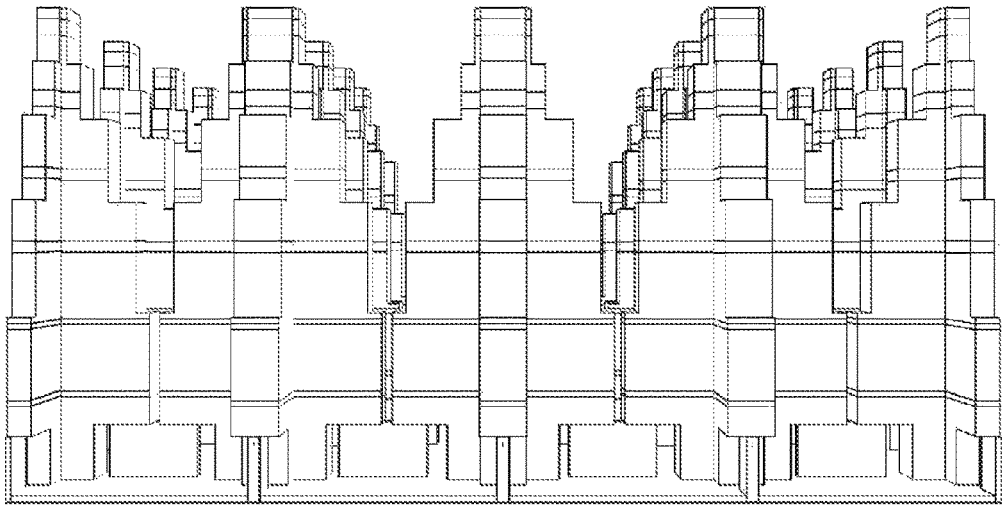
Figure 18A:
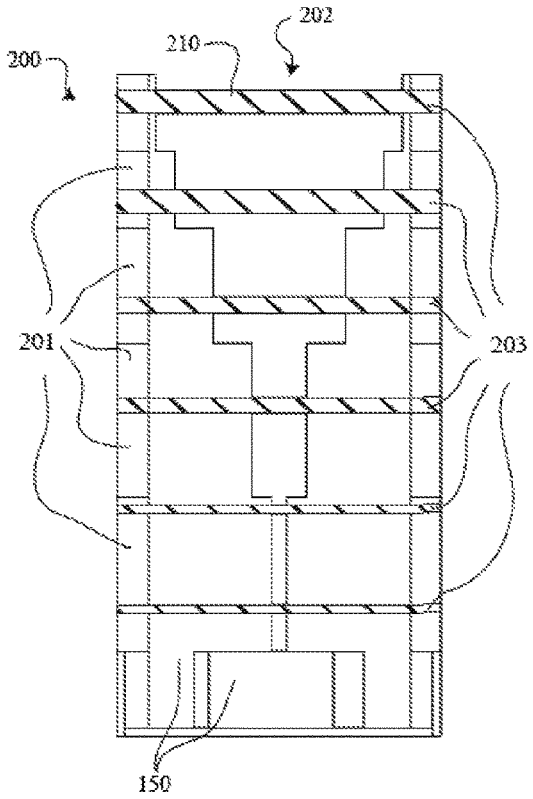
FIGS. 18A-B illustrate side and opaque/transparent isometric views, respectively, of a "Mecha-Notch"-based antenna element with non-conductive/low-conductivity materials forming gap regions spanning across the unit cell.
Figure 18B:
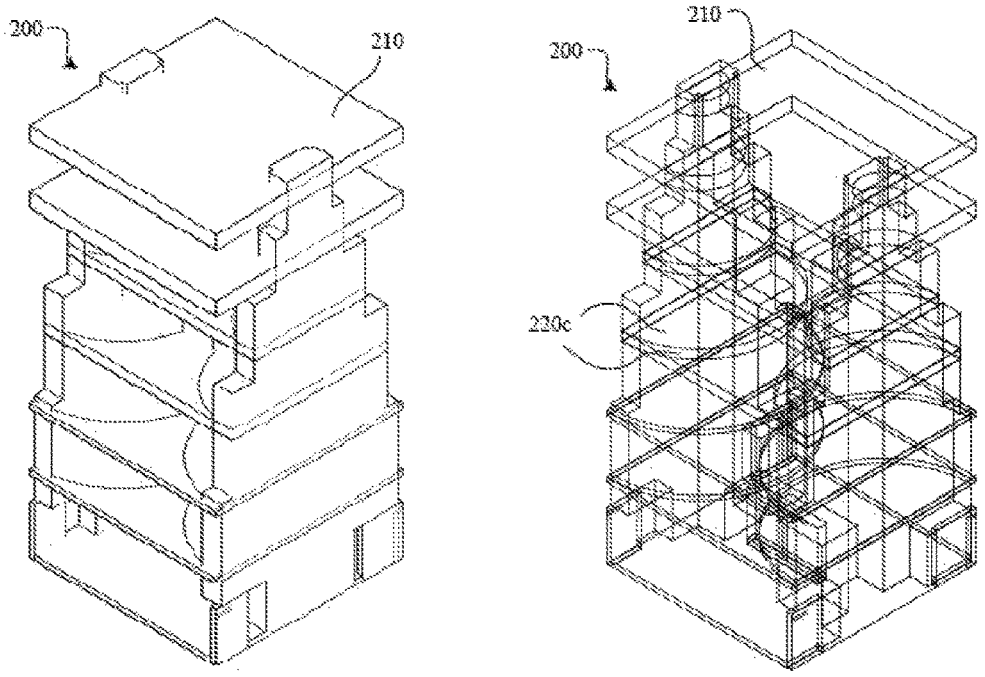
Figure 19A:
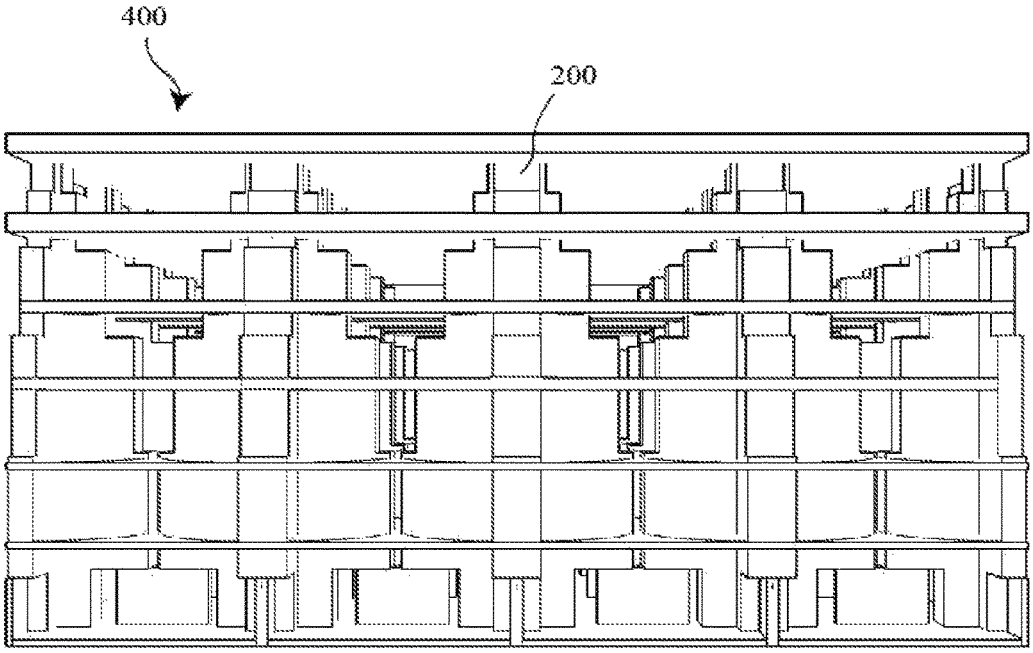
FIGS. 19A-B illustrate a 4×4 dual-polarized embodiment of the "Mecha-Notch" antenna element of FIGS. 18A-B.
Figure 19B:
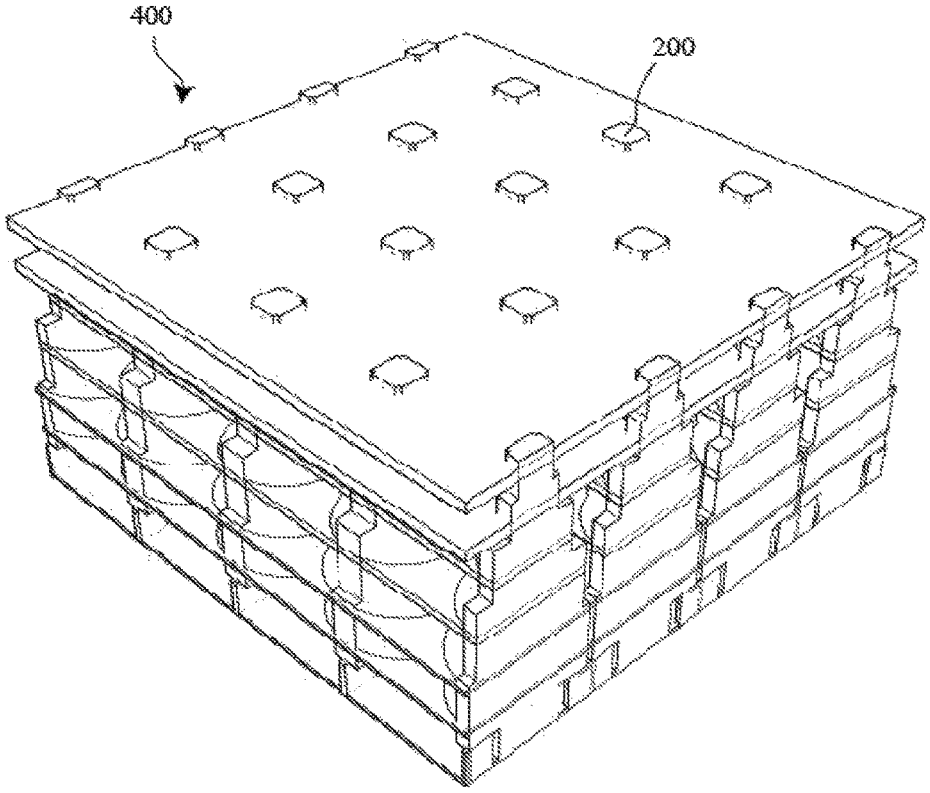

A more specific version of a stepped notch antenna element is the "Mecha-Notch" antenna element, in which the steps are overall of lesser thickness and the ground plane and bottom segments support a stripline feed segment to be inserted and fastened in the array body. It is appreciated that the sliced notch antenna element can be manufactured in a same way that the Mecha-Notch is. An embodiment of the inventive antenna element 200 that embodies this architecture is illustrated in FIG. 16, which illustrates a disconnecting radiator body 201 and gap regions 203 forming a tapered slot region 202 supported by electrical and structural components 150. A dual-polarized planar configuration 400 of the antenna element of FIG. 16 according to the invention is illustrated in the perspective and side view of FIGS. 17A-17B. Furthermore, this embodiment can be adapted to incorporate a supporting medium 210 to not be confined beneath the disconnected metallic components 201 as shown in the embodiment illustrated in FIGS. 18A-18B. A capacitive junction can be enhanced by introducing optional metallic plates 220*c* that are shown to have a circular shape. However it is appreciated that they can have any general planar shape. These capacitive plates 220*c* are electrically connected to the metallic slices that they are attached to. A dual-polarized planar configuration 400 of this embodiment is illustrated in FIGS. 19A-19B.

Figure 20:
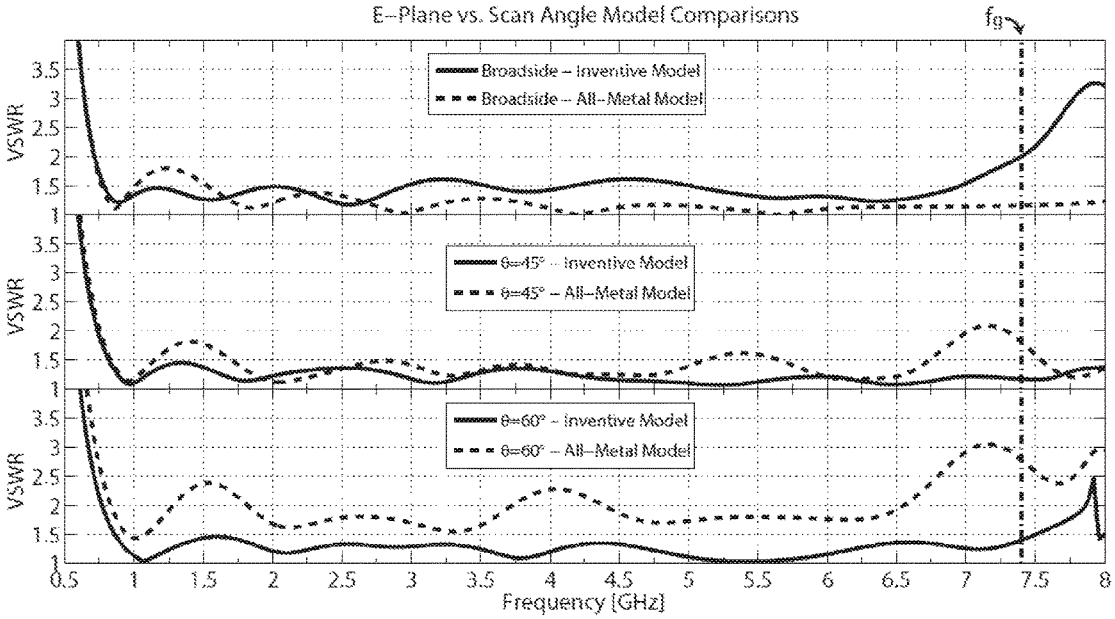
FIG. 20 illustrates the predicted infinite array impedance performance of the dual-polarized arrays of FIG. 10 having the element of FIG. 8B (all-metal Vivaldi antenna element) for broadside, 45-degree, and 60-degree scans in the E-plane.
Figure 21:
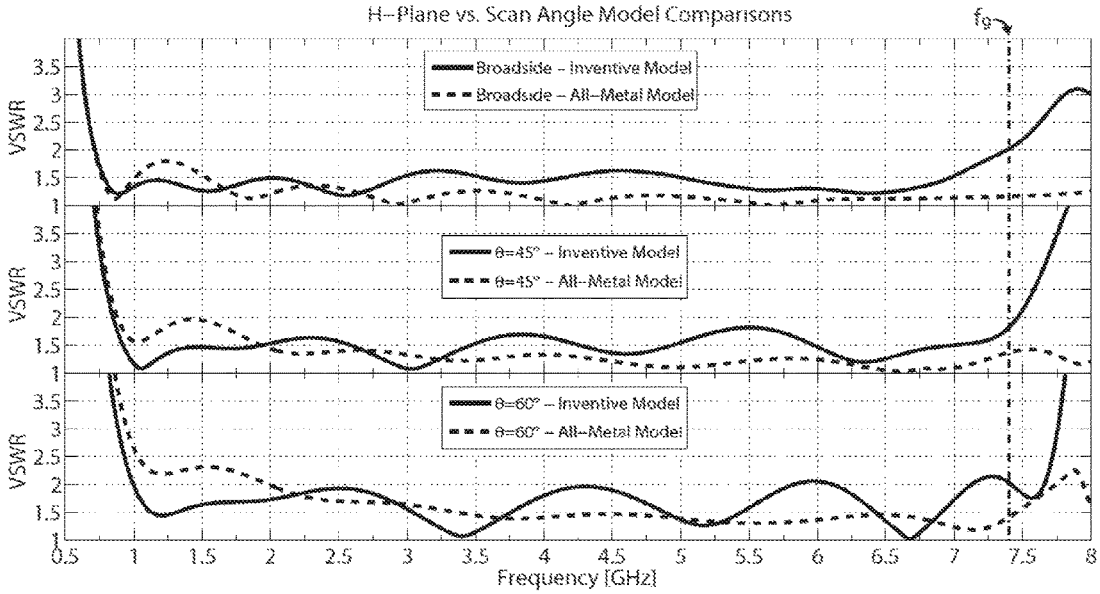
FIG. 21 illustrates the predicted infinite array impedance performance of the dual-polarized arrays of FIG. 10 having the element of FIG. 8B (all-metal Vivaldi antenna element) for broadside, 45-degree, and 60-degree scans in the H-plane.

It is clear from the above described various embodiments that the antenna element according to the invention may encompass a plurality of embodiments, using some of the more popular fabrication methods, although the antenna element is certainly not limited to those cases. With proper design and tuning, the introduction of the gap regions 203 also has a relatively minor impact on the predicted infinite array impedance performance (VSWR) within the operating band as seen from the E-plane and H-plane plots in FIG. 20 and FIG. 21, as can be seen by comparing the all-metal decade bandwidth (10:1) dual-polarized Vivaldi-type antenna as illustrated in FIG. 2B with one embodiment of the inventive antenna element of FIG. 8B having the same dimensions and structure except for the additional inventive components.

In fact, the VSWR improves in the low-frequency range greatly for the broadside, 45 degree, and 60 degree scans in the principal E-/H-planes due to capacitive loading introduced by the gap regions 203. Additionally, the E-plane scanning is significantly enhanced at wide-angles while the H-plane scanning remains below 2.15 across the operating band. The broadside VSWR displays minor degradation in the midband-frequency and high-frequency ranges, but overall remains below 2 out to the grating lobe frequency, $f_g$, for ideal aperture sampling on a typical rectangular grid with $\lambda_g/2$ periodically spaced elements (where $\lambda_g$ is the free-space wavelength of the $f_g$ and is ideally equal to the operating band high-frequency wavelength, $\lambda_{high}$). Assuming that the upper-frequency is dictated by $f_g$, the antenna element according to the invention retains the same decade bandwidth with an overall VSWR improvement.

Figure 22:
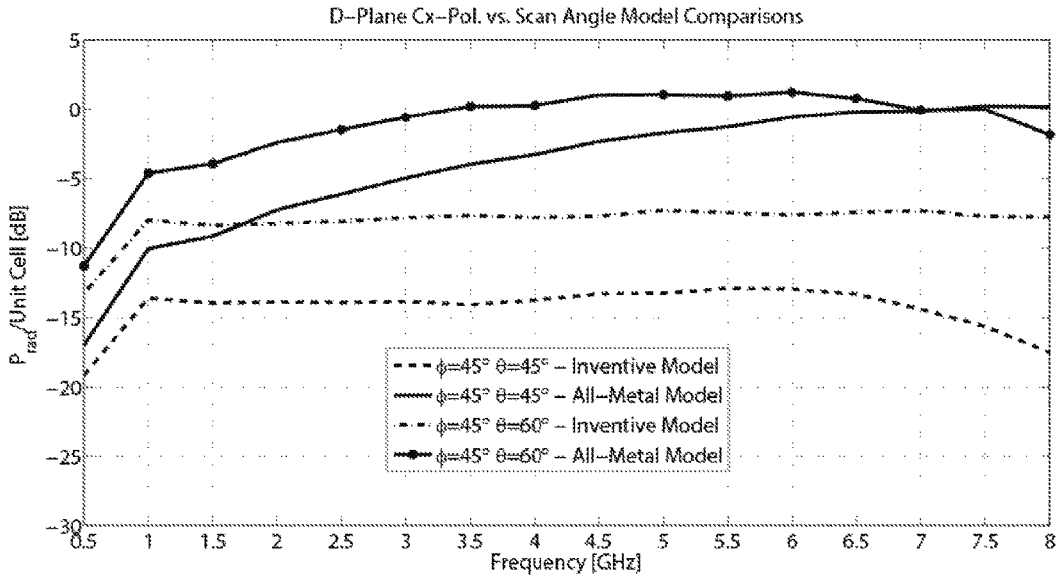
FIG. 22 illustrates the predicted infinite array cross-polarization levels radiated by a unit cell of the dual-polarized arrays of FIG. 10 having the element of FIG. 8B (all-metal Vivaldi antenna element) for 45-degree and 60-degree scans in the D-plane ($\phi$=45 degrees)
Figure 23:
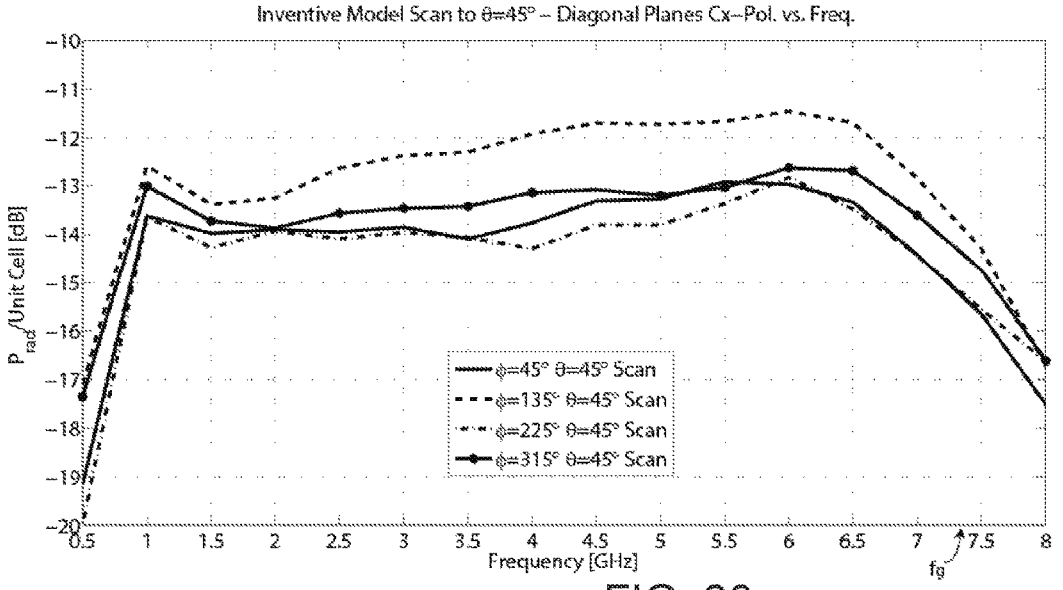
FIG. 23 illustrates the predicted infinite array cross-polarization levels radiated by a unit cell of the dual-polarized arrays of FIG. 10 having the element of FIG. 8B, when scanned to an elevation angle of 45 degrees for diagonal plane azimuth scan directions ($\phi$) of 45, 135, 225, and 315 degrees.

The antenna element according to the various embodiments of the invention enables control of the vertical currents contributing to the radiation of cross-polarized fields that would otherwise deteriorate the polarization isolation in and around the diagonal plane scanning of the Vivaldi-type antenna element 100. With the same dual-polarized antenna structures as those used in the VSWR plots shown in FIG. 20 and FIG. 21, infinite array unit cell cross-polarization levels are computed for scans in the diagonal plane associated with the 45 degree azimuth direction (typically denoted as $\phi$) at 45 degree and 60 degree elevation angles (typically denoted as $\theta$) as shown in FIG. 22. Similar cross-polarization level computations for the inventive model can be drawn the other diagonal planes ($\phi$=135, 225, 315 degrees) as shown in FIG. 23, with results within 2 dB for all planes over the majority of the band. One polarization is excited with one watt (W) of input power while the other is terminated in 50Ω, and the two polarizations are separated by approximately $\lambda_{high}/4$ in a dual-offset dual-polarized configuration. For $\theta$=45 degrees, the Vivaldi-type antenna array exhibits a significant rise in cross-polarization with frequency to the point where cross-polarization levels are −10 dB near the low-frequency range and increasing to 0 dB near the high-frequency range at 6.5 GHz where the polarization has become orthogonal to that which in which it began and increasingly more cross-polarized with increasing frequency.

It is clear the prior art Vivaldi-type antenna array cannot scan in the diagonal plane with good polarization isolation without some sort of exterior cross-polarization correctional measure. However, the various embodiments of the antenna element of the invention has a nearly flat cross-polarization level across the entire operating band around 13 dB below the ideal co-polarized level (0 dB for 1 W of input power). Similar findings are observed for $\theta$=60 degrees, in which the conventional Vivaldi-type antenna array hits the 0 dB marker near 3.25 GHz and the cross-polarization becomes the dominant polarization for nearly the entire operating band, whereas the antenna element according to the invention is once again flat at 7.5 dB below the ideal co-polarization level. Some other more symmetric PCB embodiments have shown similar or in some cases two dB better polarization performance. Ultimately, the antenna element according to the invention intrinsically overcomes the quintessential non-principal plane (most severe in diagonal plane for dual polarized planar arrays) scanning limitation exhibited by the Vivaldi-type antenna array across the entire operational band.

Thus it is appreciated that the various embodiments of the antenna element according to invention are capable of simultaneously achieving bandwidths in excess of one decade and low scanning cross-polarization in the entire scan volume (including the diagonal planes) due to its inventive structure, whereas the scan volume of Vivaldi arrays becomes increasingly truncated in/around the diagonal planes with increasing bandwidths. No other UWB-ESA is capable of achieving this without significant gain losses or external cross-polarization correctional hardware.

Another aspect of the various embodiments of the antenna element of the invention is that they are easier to fabricate/assemble for common embodiments requiring interweaving of orthogonal polarizations as its radiator body is composed of smaller disconnected components that are easier to solder and notch for egg-crate assembly rather than a single long metallic flare of a Vivaldi requiring a difficult notching and soldering process.

Still another aspect of the various embodiments of the antenna element of the invention is that the antenna element invention improves upon principal plane (E-/H-plane) scanning performance drawbacks that conventional Vivaldi arrays suffer from such as H-plane low-frequency drifting and high-frequency scan anomalies by intrinsically stabilizing the impedance bandwidth with its inventive structure.

Still another aspect of the various embodiments of the antenna element of the invention is that the antenna element invention remains generally backwards compliant with legacy wideband phased array hardware/platforms and prominent Vivaldi antenna elements may continue to have their baseline designs employed but with modification to their tapered slot region according to the invention.

Having described above several aspects of at least one embodiment, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A modular wideband antenna element, comprising:

a support structure comprising a feed network;

first and second arbitrarily-shaped radiator elements extending along a main axis of the antenna element, each of the first and second arbitrarily-shaped radiator elements comprising a plurality of disconnected metal radiator body components separated from one another along the main axis by gap regions, each of the first and second arbitrarily shaped radiator elements defining a wider end and a tapering free end to provide a tapered slot region, wherein the wider ends of the first and second arbitrarily-shaped radiator elements are located closer to the support structure than the tapering free ends of first and second arbitrarily-shaped radiator elements which are located farther from the support structure; and capacitive enhancing elements located between the disconnected metal radiator body components and configured to couple the gap regions to one another, wherein the first and second arbitrarily-shaped radiator elements are configured to be electrically coupled to the feed network and wherein the first and second arbitrarily-shaped radiator elements comprise any of a Vivaldi embodiment antenna element, a Body of Revolution (BOR) element having a shape of a tapered cone, and stepped notches having a taper that is stepped upwards in flat segments.

2. The modular wideband antenna element as claimed in claim 1, wherein the disconnected metal radiator body components are not electrically connected to the support structure, and wherein the capacitive enhancing elements provide for current to flow at frequencies of interest, thereby emulating a Vivaldi current distribution at frequencies of interest.

3. The modular wideband antenna element as claimed in claim 1, wherein the capacitive enhancing elements include edge plating of the disconnected metal radiator body components.

4. The modular wideband antenna element as claimed in claim 1, wherein the capacitive enhancing elements include vias connecting the disconnected metal radiator body components.

5. The modular wideband antenna element as claimed in claim 1, wherein the capacitive enhancing elements have inward notches into the disconnected metal radiator body components.

6. The modular wideband antenna element as claimed in claim 1, wherein the gap regions are configured to tune-out slot resonance.

7. The modular wideband antenna element as claimed in claim 1, wherein the gap regions are filled with non-conductive or low-conductivity materials with low relative permittivity $1 \leq \varepsilon_r \leq 10$.

8. The modular wideband antenna element as claimed in claim 1, wherein the gap regions are filled with non-conductive or low-conductivity materials selected from the list of air, PTFE dielectric, bonding ply, and/or foam.

9. The modular wideband antenna element as claimed in claim 1, wherein any of a number, location, size, and material composition of the gap regions can be varied along the longitudinal axis of the radiator element.

10. The modular wideband antenna element as claimed in claim 1, wherein the support structure protrudes into a first gap region.

11. The modular wideband antenna element as claimed in claim 1, wherein the antenna element is entirely embedded within a non-conductive or low-conductivity medium so that the disconnected metal radiator body components and gap regions are both within the medium.

12. The modular wideband antenna element as claimed in claim 1, wherein the disconnected metal radiator body components further incorporate disconnected metallic components separated from one another along a gap parallel to the main axis of the antenna body.

13. The modular wideband antenna element as claimed in claim 1, wherein the first and second arbitrarily-shaped radiator elements comprise a microstrip topology.

14. The modular wideband antenna element as claimed in claim 13, wherein the support structure comprises a slot-line cavity and a ground plane.

15. The modular wideband antenna element as claimed in claim 13, wherein the support structure comprises a microstrip balun terminated into a quarter-wave radial stub printed upon an opposite side of a mechanically supporting medium.

16. The modular wideband antenna element as claimed in claim 1, wherein the first and second arbitrarily-shaped radiator elements comprise a stripline topology.

17. The modular wideband antenna element as claimed in claim 16, wherein the support structure comprises a slot-line cavity and a ground plane.

18. The modular wideband antenna element as claimed in claim 16, wherein the support structure comprises a microstrip balun terminated into a quarter-wave radial stub printed upon an opposite side of a mechanically supporting medium.

19. The modular wideband antenna element as claimed in claim 1 wherein, wherein the gap regions are filled with a low conductivity material to provide spacing support for the metal disconnected radiator body components.

20. The modular wideband antenna element as claimed in claim 19, wherein the metal disconnected radiator body components are configured for high-power usage.

21. The modular wideband antenna element as claimed in claim 1, wherein the first and second arbitrarily-shaped radiator elements comprise a hybrid design of PCB all-metal EDM or additive manufacturing (3D printing) methods.

22. The modular wideband antenna element as claimed in claim 1, wherein the first and second arbitrarily-shaped radiator elements comprise Body of Revolution (BOR) elements having a shape of a tapered cone.

23. The modular wideband antenna element as claimed in claim 1 wherein the first and second arbitrarily-shaped radiator elements comprise stepped notches having a taper that is stepped upwards in flat segments.

24. The modular wideband antenna element as claimed in claim 23, wherein the stepped notches comprise steps having overall lesser thickness.

25. The modular wideband antenna element as claimed in claim 1 configured as an antenna array, the antenna array comprising:

a plurality of unit cells arranged in the antenna array, each of said unit cells including an antenna element, each said antenna element including the first and second arbitrarily shaped radiator elements, each of the first and second arbitrarily-shaped radiator elements comprising the disconnected metal radiator body components separated by the gap regions.

26. The modular wideband antenna element as claimed in claim 25, wherein the gap regions are supported by non-conductive or low-conductivity layers that fully extend across adjacent antenna elements in the antenna array.

* * * * *